US009501898B1

(12) United States Patent
Gerchak et al.

(10) Patent No.: US 9,501,898 B1
(45) Date of Patent: Nov. 22, 2016

(54) GAMING SYSTEM AND METHOD PROVIDING A GAME HAVING A SUB-SYMBOL AWARD EVALUATION

(71) Applicant: IGT, Las Vegas, NV (US)

(72) Inventors: Christian D. Gerchak, Sparks, NV (US); William K. Hughes, Reno, NV (US); Kelsy J. Grace, Reno, NV (US)

(73) Assignee: IGT, Las Vegas, NV (US)

( * ) Notice: Subject to any disclaimer, the term of this patent is extended or adjusted under 35 U.S.C. 154(b) by 277 days.

(21) Appl. No.: 14/025,037

(22) Filed: Sep. 12, 2013

(51) Int. Cl.
*G07F 17/32* (2006.01)
*G07F 17/34* (2006.01)

(52) U.S. Cl.
CPC ..... *G07F 17/3244* (2013.01); *G07F 17/34* (2013.01)

(58) Field of Classification Search
None
See application file for complete search history.

(56) References Cited

U.S. PATENT DOCUMENTS

| | | | |
|---|---|---|---|
| 5,205,555 | A | 4/1993 | Hamano |
| 5,393,061 | A | 2/1995 | Manship et al. |
| 5,395,111 | A | 3/1995 | Inoue |
| 5,449,173 | A | 9/1995 | Thomas et al. |
| 5,611,535 | A | 3/1997 | Tiberio |
| 5,752,881 | A | 5/1998 | Inoue |
| 5,769,716 | A | 6/1998 | Saffari et al. |
| 5,833,537 | A | 11/1998 | Barrie |
| 5,890,962 | A | 4/1999 | Takemoto |
| 5,980,384 | A | 11/1999 | Barrie |
| 5,997,401 | A | 12/1999 | Crawford |
| 6,027,115 | A | 2/2000 | Griswold et al. |
| 6,033,307 | A | 3/2000 | Vancura |
| 6,056,642 | A | 5/2000 | Bennett |
| 6,059,289 | A | 5/2000 | Vancura |
| 6,095,921 | A | 8/2000 | Walker et al. |
| 6,120,378 | A | 9/2000 | Moody et al. |
| 6,165,070 | A | 12/2000 | Nolte et al. |
| 6,190,254 | B1 | 2/2001 | Bennett |
| 6,220,959 | B1 | 4/2001 | Holmes, Jr. et al. |
| 6,270,411 | B1 | 8/2001 | Gura et al. |
| 6,311,976 | B1 | 11/2001 | Yoseloff et al. |
| 6,315,660 | B1 | 11/2001 | DeMar et al. |
| 6,336,860 | B1 | 1/2002 | Webb |
| 6,346,043 | B1 | 2/2002 | Colin et al. |
| 6,364,766 | B1 | 4/2002 | Anderson et al. |

(Continued)

FOREIGN PATENT DOCUMENTS

| | | |
|---|---|---|
| AU | 74936/87 | 6/1987 |
| EP | 0060019 | 9/1982 |

(Continued)

*Primary Examiner* — Kang Hu
*Assistant Examiner* — Robert T Clarke, Jr.
(74) *Attorney, Agent, or Firm* — Neal, Gerber & Eisenberg LLP

(57) ABSTRACT

Various embodiments of the present disclosure provide a gaming system and method providing a game having a sub-symbol award evaluation. Generally, in various embodiments, if an outcome of a play of the game includes a set of one or more displayed designated symbols that are each associated with a same one of a plurality of different characteristics and that are collectively associated with a quantity of sub-symbols that is at least a designated quantity, the gaming system determines an award based on that particular characteristic and that particular quantity of sub-symbols. Put differently, the determined award varies based on the particular characteristic associated with each of those displayed designated symbols and the particular quantity of sub-symbols collectively associated with those displayed designated symbols.

20 Claims, 18 Drawing Sheets

(56) References Cited

U.S. PATENT DOCUMENTS

| | | | |
|---|---|---|---|
| 6,439,993 | B1 | 8/2002 | O'Halloran |
| 6,551,187 | B1 | 4/2003 | Jaffe |
| 6,561,900 | B1 | 5/2003 | Baerlocher et al. |
| 6,616,142 | B2 | 9/2003 | Adams |
| 6,731,313 | B1 | 5/2004 | Kaminkow |
| 6,749,502 | B2 | 6/2004 | Baerlocher |
| 6,855,053 | B2 | 2/2005 | Baerlocher |
| 6,866,583 | B2 | 3/2005 | Glavich et al. |
| 6,964,416 | B2 | 11/2005 | McClintic et al. |
| 7,040,983 | B2 | 5/2006 | Dolloff et al. |
| 7,128,646 | B2 | 10/2006 | Baerlocher et al. |
| 7,399,226 | B2 | 7/2008 | Mishra |
| 7,402,102 | B2 | 7/2008 | Marks et al. |
| 7,448,948 | B2 | 11/2008 | Hughs-Baird et al. |
| 7,585,219 | B2 | 9/2009 | Randall et al. |
| 7,591,724 | B2 | 9/2009 | Baerlocher |
| 7,674,173 | B2 | 3/2010 | Bennett |
| 7,674,180 | B2 | 3/2010 | Graham et al. |
| 7,862,421 | B2 | 1/2011 | Marks et al. |
| 7,874,908 | B2 | 1/2011 | Walker et al. |
| 7,909,690 | B2 | 3/2011 | Low |
| 8,002,625 | B2 | 8/2011 | Maya |
| 8,021,226 | B2 | 9/2011 | Souza et al. |
| 8,070,597 | B2 | 12/2011 | Cuddy |
| 8,113,942 | B2 | 2/2012 | Hoffman et al. |
| 8,118,666 | B2 | 2/2012 | Nicely et al. |
| 8,162,741 | B2 | 4/2012 | Wadleigh et al. |
| 8,231,454 | B2 | 7/2012 | Caputo |
| 8,277,302 | B2 | 10/2012 | Walker et al. |
| 8,277,305 | B2 | 10/2012 | Caputo et al. |
| 8,287,357 | B2 | 10/2012 | Evans |
| 8,298,081 | B1 | 10/2012 | Merritt et al. |
| 8,323,091 | B2 | 12/2012 | Frank et al. |
| 8,382,574 | B2 | 2/2013 | Marks et al. |
| 8,430,739 | B2 | 4/2013 | Rodgers |
| 8,444,473 | B2 | 5/2013 | Ching et al. |
| 8,454,434 | B1 | 6/2013 | Schaefer et al. |
| 8,475,265 | B2 | 7/2013 | Lafky et al. |
| 8,545,307 | B2 | 10/2013 | Nicely et al. |
| 8,574,059 | B2 | 11/2013 | Rodgers et al. |
| 8,585,487 | B2 | 11/2013 | Rodgers et al. |
| 8,608,545 | B2 | 12/2013 | Arora et al. |
| 8,641,505 | B2 | 2/2014 | Spark-Stahl et al. |
| 8,651,947 | B2 | 2/2014 | Caputo et al. |
| 8,662,986 | B2 | 3/2014 | Rodgers et al. |
| 8,672,740 | B2 | 3/2014 | Nicely |
| 8,678,908 | B2 | 3/2014 | Nicely |
| 2002/0094857 | A1 | 7/2002 | Meyer |
| 2003/0125105 | A1 | 7/2003 | Bennett |
| 2004/0009803 | A1 | 1/2004 | Bennett et al. |
| 2004/0023714 | A1 | 2/2004 | Asdale |
| 2004/0048650 | A1 | 3/2004 | Mierau et al. |
| 2005/0054418 | A1 | 3/2005 | Baerlocher |
| 2006/0073879 | A1* | 4/2006 | Baerlocher ..... 463/20 |
| 2008/0032783 | A1 | 2/2008 | Walker et al. |
| 2008/0182650 | A1 | 7/2008 | Randall et al. |
| 2009/0042652 | A1 | 2/2009 | Baerlocher et al. |
| 2009/0124364 | A1 | 5/2009 | Cuddy et al. |
| 2010/0029364 | A1* | 2/2010 | Zielinski ..... 463/20 |
| 2010/0137056 | A1 | 6/2010 | Hoffman et al. |
| 2011/0003627 | A1 | 1/2011 | Nicely et al. |
| 2013/0053122 | A1 | 2/2013 | Spark-Stahl et al. |
| 2013/0079098 | A1 | 3/2013 | Nicely et al. |
| 2013/0079108 | A1 | 3/2013 | Lafky et al. |
| 2013/0260868 | A1 | 10/2013 | Caputo et al. |
| 2013/0260869 | A1 | 10/2013 | Basallo et al. |
| 2013/0303265 | A1 | 11/2013 | Wilkins et al. |
| 2013/0337902 | A1 | 12/2013 | Schaefer et al. |
| 2013/0344930 | A1 | 12/2013 | Caputo et al. |
| 2014/0038698 | A1 | 2/2014 | Caputo |
| 2014/0066162 | A1 | 3/2014 | Basallo et al. |
| 2014/0087808 | A1 | 3/2014 | Basallo et al. |
| 2014/0087815 | A1 | 3/2014 | Caputo et al. |
| 2014/0087821 | A1 | 3/2014 | Zoltewicz et al. |
| 2014/0087824 | A1 | 3/2014 | Caputo et al. |
| 2014/0087825 | A1 | 3/2014 | Nicely et al. |
| 2014/0087840 | A1 | 3/2014 | Smith et al. |
| 2014/0087844 | A1 | 3/2014 | Gilliland et al. |
| 2014/0087861 | A1 | 3/2014 | Basallo et al. |
| 2014/0087878 | A1 | 3/2014 | Basallo et al. |

FOREIGN PATENT DOCUMENTS

| | | |
|---|---|---|
| EP | 0410789 | 1/1991 |
| EP | 0698869 | 12/1994 |
| EP | 0984408 | 3/2000 |
| EP | 1205984 | 5/2002 |
| WO | WO 00/66235 | 11/2000 |
| WO | WO 00/76606 | 12/2000 |

* cited by examiner

GAMING SYSTEM AND METHOD PROVIDING A GAME HAVING A SUB-SYMBOL AWARD EVALUATION

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but at reserves all copyright rights whatsoever.

BACKGROUND

Gaming systems that provide players awards in primary or base games are well known. The gaming systems generally require a player to place a wager to activate a play of the primary game. For many of these gaming systems, any award provided to a player for a wagered-on play of a primary game is based on the player obtaining a winning symbol or a winning symbol combination and on an amount of the wager (e.g., the higher the amount of the wager, the higher the award). Winning symbols or winning symbol combinations that are less likely to occur typically result in larger awards being provided when they do occur.

For such known gaming systems, an amount of a wager placed on a primary game by a player may vary. For instance, a gaming system may enable a player to wager a minimum quantity of credits, such as one credit (e.g., in monetary currency, one penny, nickel, dime, quarter, or dollar; in non-monetary currency, one point, credit, coin, token, free play credit, or virtual buck), up to a maximum quantity of credits, such as five credits. The gaming system may enable the player to place this wager a single time or multiple times for a single play of the primary game. For instance, a gaming system configured to operate a slot game may have one or more paylines, and the gaming system may enable a player to place a wager on each of the paylines for a single play of the slot game. Thus, it is known that a gaming system, such as one configured to operate a slot game, may enable players to place wagers of substantially different amounts on each play of a primary game. For example, the amounts of the wagers may range from one credit up to 125 credits (e.g., five credits on each of twenty-five separate paylines). This is also true for other wagering games, such as video draw poker, in which players can place wagers of one or more credits on each hand, and in which multiple hands can be played simultaneously. Accordingly, it should be appreciated that different players play at substantially different wager amounts or levels and substantially different rates of play.

Bonus or secondary games are also known in gaming systems. Such gaming systems usually provide an award to a player for a play of one such bonus game in addition to any awards provided for any plays of any primary games. Bonus games usually do not require an additional wager to be placed by the player to be initiated. Bonus games are typically initiated or triggered upon an occurrence of a designated triggering symbol or designated triggering symbol combination in the primary game. For instance, a gaming system may initiate or trigger a bonus game when a bonus symbol occurs on the payline on the third reel of a three reel slot machine. The gaming systems generally indicates when a bonus game is initiated or triggered through one or more visual and/or audio output devices, such as the reels, lights, speakers, display screens, etc. Part of the enjoyment and excitement of playing certain gaming systems is the initiation or triggering of a bonus game, even before the player knows an amount of a bonus award won via the bonus game.

Various players continually seek out new and different variations to gaming systems. A continuing need thus exists for gaming systems and methods that provide new, exciting, and engaging games.

SUMMARY

Various embodiments of the present disclosure provide a gaming system and method providing a game having a sub-symbol award evaluation.

Generally, in various embodiments, if an outcome of a play of the game includes a set of one or more displayed designated symbols that are each associated with a same one of a plurality of different characteristics and that are collectively associated with a quantity of sub-symbols that is at least a designated quantity, the gaming system determines an award based on that particular characteristic and that particular quantity of sub-symbols. Put differently, the determined award varies based on the particular characteristic associated with each of those displayed designated symbols and the particular quantity of sub-symbols collectively associated with those displayed designated symbols.

More specifically, in operation of one embodiment, the gaming system initiates a play of a game associated with a plurality of different symbols. In this embodiment: (a) the plurality of different symbols includes a plurality of non-designated symbols and a plurality of designated symbols; (b) each designated symbol is associated with one or more of a plurality of different sub-symbols; (c) for each designated symbol, that designated symbol and the one or more sub-symbols associated with that designated symbol are associated with a same one of a plurality of different characteristics; and (d) at least two designated symbols are associated with different characteristics.

For the play of the game, for each of a plurality of symbol display areas, the gaming system displays one of the plurality of different symbols and any sub-symbols associated with that symbol at that symbol display area. The gaming system determines and displays any awards associated with any displayed non-designated symbols. If at least one set of one or more designated symbols that: (A) are each associated with a same one of the characteristics, and (B) are collectively associated with at least a designated quantity of sub-symbols is displayed, for each such set, the gaming system determines and displays an award associated with that set based on: (a) the characteristic associated with the one or more displayed designated symbols of that set, and (b) a quantity of sub-symbols that are collectively associated with the one or more displayed designated symbols of that set.

In this embodiment, the determined award is: (a) a first award when the characteristic associated with the one or more displayed designated symbols of that set is a first characteristic and the quantity of sub-symbols that are collectively associated with the one or more displayed designated symbols of that set is a first quantity; (b) a second award when the characteristic associated with the one or more displayed designated symbols of that set is a second different characteristic and the quantity of sub-symbols that are collectively associated with the one or more displayed designated symbols of that set is the first quantity, the second award being different than the first award; and (c) a third award when the characteristic associated with the one or more displayed designated symbols of that set is the first characteristic and the quantity of sub-symbols that are collectively associated with the one or more displayed designated symbols of that set is a second different quantity, the third award being different than the first award.

Generally, in other embodiments, if an outcome of a play of the game includes a set of one or more displayed designated symbols that are collectively associated with a quantity of sub-symbols that is at least a designated quantity, the gaming system determines an award based on that particular quantity of sub-symbols. Put differently, in these embodiments, the determined award varies based on the particular quantity of sub-symbols collectively associated with those displayed designated symbols.

More specifically, in operation of one embodiment, the gaming system initiates a play of a game associated with a plurality of different symbols. In this embodiment: (a) the plurality of different symbols includes a plurality of non-designated symbols and a plurality of designated symbols; and (b) each designated symbol is associated with one or more sub-symbols. For the play of the game, for each of a plurality of symbol display areas, the gaming system displays one of the plurality of different symbols and any sub-symbols associated with that symbol at that symbol display area. The gaming system determines and displays any awards associated with any displayed non-designated symbols. If at least one set of one or more designated symbols that are collectively associated with at least a designated quantity of sub-symbols is displayed, for each such set, the gaming system determines and displays an award associated with that set based on a quantity of sub-symbols that are collectively associated with the one or more displayed designated symbols of that set.

Generally, in various embodiments, if an outcome of a play of the game includes a set of one or more displayed designated symbols that are collectively associated with a quantity of sub-symbols that is at least a designated quantity, the gaming system determines an award based on the characteristic(s) associated with the sub-symbols associated with those displayed designated symbols and that particular quantity of sub-symbols. Put differently, in these embodiments, the determined award varies based on the particular characteristics associated with the sub-symbols associated with those displayed designated symbols and/or the particular quantities of sub-symbols collectively associated with those displayed designated symbols.

More specifically, in operation of one embodiment, the gaming system initiates a play of a game associated with a plurality of different symbols. In this embodiment: (a) the plurality of different symbols includes a plurality of non-designated symbols and a plurality of designated symbols, (b) each designated symbol is associated with one or more of a plurality of different sub-symbols, (c) each sub-symbol is associated with one of a plurality of different characteristics, and (d) at least two sub-symbols are associated with different characteristics. For the play of the game, for each of a plurality of symbol display areas, the gaming system displays one of the plurality of different symbols and any sub-symbols associated with that symbol at that symbol display area.

The gaming system determines and displays any awards associated with any displayed non-designated symbols. If at least one set of one or more designated symbols that are collectively associated with at least a designated quantity of sub-symbols is displayed, for each such set, the gaming system determines and displays an award associated with that set based on: (a) the characteristic(s) associated with the sub-symbols associated with the one or more displayed designated symbols of that set, and (b) a quantity of sub-symbols that are collectively associated with the one or more displayed designated symbols of that set.

It should thus be appreciated that the gaming system and method of the present disclosure provide a new game to increase player engagement, enjoyment, entertainment, and excitement.

Additional features and advantages are described herein, and will be apparent from, the following Detailed Description and the Figures.

DETAILED DESCRIPTION

Game Having a Sub-Symbol Award Evaluation

Various embodiments of the present disclosure provide a gaming system and method providing a game having a sub-symbol award evaluation. While the game is implemented as a primary wagering game in the embodiments described herein, it should be appreciated that the game of the present disclosure may additionally or alternatively be implemented as a bonus or secondary game. Further, while any credit balances, any wagers, and any awards are displayed as amounts of monetary currency or credits, one or more of such credit balances, such wagers, and such awards may be for any suitable non-monetary credits or currency, promotional credits, and/or player tracking points or credits.

Award Evaluation Based on Characteristics Associated with Designated Symbols and Quantities of Sub-Symbols Generally, in various embodiments, if an outcome of a play of the game includes a set of one or more displayed designated symbols that are each associated with a same one of a plurality of different characteristics and that are collectively associated with a quantity of sub-symbols that is at least a designated quantity, the gaming system determines an award based on that particular characteristic and that particular quantity of sub-symbols. Put differently, in these embodiments, the determined award varies based on the particular characteristic associated with each of those displayed designated symbols and/or the particular quantity of sub-symbols collectively associated with those displayed designated symbols.

Figure 1:
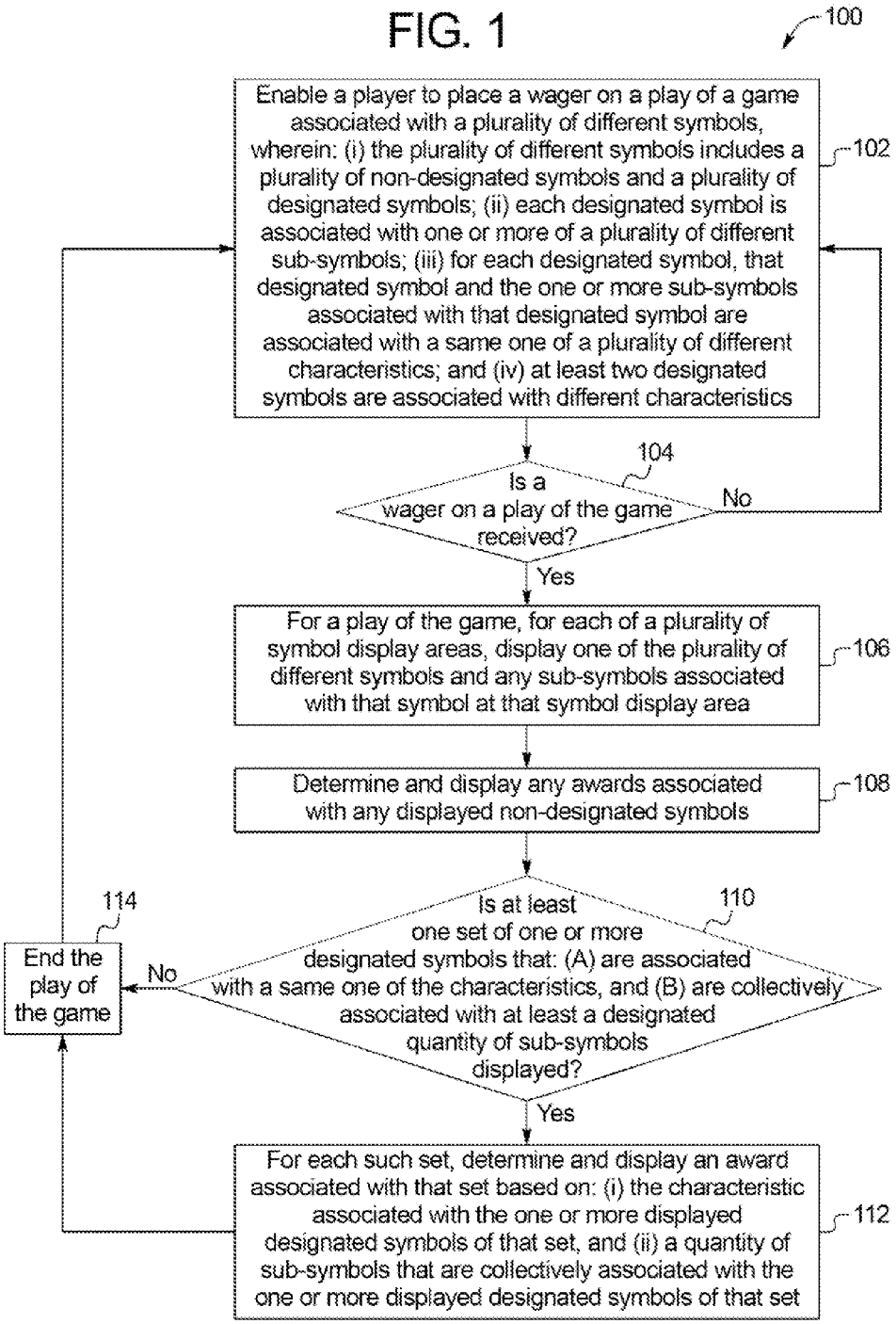
FIG. 1 is a flowchart illustrating an example method of operating one embodiment of the gaming system of the present disclosure.

FIG. 1 illustrates a flowchart of an example process or method 100 of operating one embodiment of the gaming system of the present disclosure. In various embodiments, the process 100 is represented by a set of instructions stored in one or more memories and executed by one or more processors. Although the process 100 is described with reference to the flowchart shown in FIG. 1, it should be appreciated that many other processes of performing the acts associated with this illustrated process 100 may be employed. For example, the order of certain of the illustrated blocks and/or diamonds may be changed, certain of the illustrated blocks and/or diamonds may be optional, and/or certain of the illustrated blocks and/or diamonds may not be employed.

In operation of this example embodiment, the gaming system enables a player to place a wager on a play of a game associated with a plurality of different symbols, as indicated by block 102. In this example embodiment: (a) the plurality of different symbols includes a plurality of non-designated symbols and a plurality of designated symbols; (b) each designated symbol is associated with one or more of a plurality of different sub-symbols; (c) for each designated symbol, that designated symbol and the one or more sub-symbols associated with that designated symbol are associated with a same one of a plurality of different characteristics; and (d) at least two designated symbols are associated with different characteristics.

The gaming system determines whether a wager on a play of the game was received, as indicated by diamond 104. If the gaming system determines that a wager on a play of the game was not received, the process 100 returns to block 102. If, on the other hand, the gaming system determines that a wager on a play of the game was received, for a play of the game, for each of a plurality of symbol display areas, the gaming system displays one of the plurality of different symbols and any sub-symbols associated with that symbol at that symbol display area, as indicated by block 106. The gaming system determines and displays any awards associated with any displayed non-designated symbols, as indicated by block 108. The gaming system determines if at least one set of one or more designated symbols that: (a) are each associated with a same one of the characteristics, and (b) are collectively associated with at least a designated quantity of sub-symbols is displayed, as indicated by diamond 110.

If the gaming system determines that at least one such set of one or more designated symbols is not displayed, the gaming system ends the play of the game, as indicated by block 114, and the process 100 returns to block 102. If, on the other hand, the gaming system determines that at least one such set of one or more designated symbols is displayed, for each such set, the gaming system determines and displays an award associated with that set based on: (a) the characteristic associated with the one or more displayed designated symbols of that set, and (b) a quantity of sub-symbols that are collectively associated with the one or more displayed designated of that set, as indicated by block 112. The gaming system ends the play of the game, as indicated by block 114, and the process 100 returns to block 102.

It should be appreciated that, in this example embodiment, the awards determined by the gaming system for different such sets of one or more displayed designated symbols vary based, at least in part, on the particular characteristics associated with the one or more displayed designated symbols of the sets and/or the particular quantities of sub-symbols collectively associated with the one or more displayed designated symbols of the sets.

For instance, in this example embodiment, the determined award for a particular set is: (a) a first award when the characteristic associated with the one or more displayed designated symbols of that set is a first characteristic and the quantity of sub-symbols that are collectively associated with the one or more displayed designated symbols of that set is a first quantity; (b) a second award when the characteristic associated with the one or more displayed designated symbols of that set is a second different characteristic and the quantity of sub-symbols that are collectively associated with the one or more displayed designated symbols of that set is the first quantity, the second award being different than the first award; and (c) a third award when the characteristic associated with the one or more displayed designated symbols of that set is the first characteristic and the quantity of sub-symbols that are collectively associated with the one or more displayed designated symbols of that set is a second different quantity, the third award being different than the first award.

It should also be appreciated that, in this example embodiment, the gaming system determines the award for a particular set of one or more displayed designated symbols that: (a) are each associated with a same one of the characteristics, and (b) are collectively associated with at least a designated quantity of sub-symbols based on: (a) the characteristic associated with the one or more displayed designated symbols of that set, and (b) a quantity of sub-symbols that are collectively associated with the one or more displayed designated of that set, and not based on a quantity of designated symbols included in that set. For instance, if the designated quantity of sub-symbols is four, in this example embodiment the gaming system determines the same award regardless of whether the set includes one designated symbol associated with four sub-symbols or four designated symbols each associated with one sub-symbol.

In other embodiments, however, the award varies based on the quantity of designated symbols included in the set. For instance, in one example embodiment, the gaming system determines larger awards as the set includes more designated symbols, and vice-versa. In another example embodiment, the gaming system determines larger awards as the set includes fewer designated symbols, and vice-versa.

FIGS. 2A, 2B, 2C, 2D, and 2E illustrate screen shots of one example embodiment of the gaming system of the present disclosure providing a plurality of plays of one example embodiment of the game of the present disclosure. In this example embodiment, the game is a slot game employing a plurality of reels 205*a*, 205*b*, 205*c*, 205*d*, and 205*e*, each of which is associated with a plurality of a plurality of different symbols associated with the slot game. In this example embodiment, the plurality of different symbols associated with the slot game includes a plurality of non-designated symbols and a plurality of designated symbols. In this example embodiment, each designated symbol is associated with a quantity of at least one of a plurality of different sub-symbols. Further, each designated symbol and the sub-symbol(s) associated with that designated symbol are associated with a same one of a plurality of different characteristics. In this example embodiment: (a) the designated symbols are peacock symbols; (b) the sub-symbols are feather sub-symbols; and (c) the plurality of characteristics includes the following three different shading patterns: a hatched shading pattern, a cross-hatched shading pattern, and a dotted shading pattern. It should thus be appreciated that, in this example embodiment, the plurality of symbols employed for the slot game includes a plurality of non-designated symbols and a plurality of designated peacock symbols associated with different quantities of feather sub-symbols and different shading patterns.

It should be appreciated that any suitable patterns may be employed. It should also be appreciated that any suitable plurality of different characteristics may be employed instead of, or in addition to, patterns. For instance, in one example embodiment, the plurality of different characteristics include a plurality of different colors.

In this example embodiment, each reel is associated with a different maximum quantity of feather sub-symbols that may be associated with the designated peacock symbols associated with that reel. Here, the reel 205*a* is associated with a maximum quantity of one feather sub-symbol, the reel 205*b* is associated with a maximum quantity of two feather sub-symbols, the reel 205*c* is associated with a maximum quantity of three feather sub-symbols, the reel 205*d* is associated with a maximum quantity of four feather sub-symbols, and the reel 205*e* is associated with a maximum quantity of five feather sub-symbols. Thus, in this example embodiment: (a) each designated peacock symbol associated with the reel 205*a* is associated with only one feather sub-symbol, (b) each designated peacock symbol associated with the reel 205*b* is associated with at least one but no more than two feather sub-symbols, (c) each designated peacock symbol associated with the reel 205*c* is associated with at least one but no more than three feather sub-symbols, (d) each designated peacock symbol associated with the reel 205*d* is associated with at least one but no more than four feather sub-symbols, and (e) each designated peacock symbol associated with the reel 205*e* is associated with at least one but no more than five feather sub-symbols.

Additionally, in this example embodiment, at least one of the reels is associated with a Wild symbol. Here, when the gaming system includes the Wild symbol as part of a set of displayed designated peacock symbols (described below), the Wild symbol represents a designated peacock symbol associated with: (a) the maximum quantity of feather sub-symbols associated with the reel with which that Wild symbol is associated, and (b) whichever characteristic that maximizes the award (if any) associated with that Wild symbol. For instance, if the Wild symbol is displayed at one of the symbol display areas associated with the reel 205*e*, the Wild symbol represents a designated peacock symbol associated with five feather sub-symbols.

The gaming system displays, such as on a display device 1116 or 1118 (described below), a plurality of symbol display areas 210*a*, 210*b*, 210*c*, 210*d*, 210*e*, 210*f*, 210*g*, 210*h*, 210*i*, 210*j*, 210*k*, 210*l*, 210*m*, 210*n*, and 210*o* arranged in a 3×5 grid or matrix. The gaming system displays the plurality of reels 205*a*, 205*b*, 205*c*, 205*d*, and 205*e*, each of which is associated with, and configured to display symbols at, a plurality of the symbol display areas. More specifically: (a) the reel 205*a* is associated with, and configured to display symbols at, the symbol display areas 210*a*, 210*f*, and 210*k*; (b) the reel 205*b* is associated with, and configured to display symbols at, the symbol display areas, 210*b*, 210*g*, and 210*l*; (c) the reel 205*c* is associated with, and configured to display symbols at, the symbol display areas 210*c*, 210*h*, and 210*m*; (d) the reel 205*d* is associated with, and configured to display symbols at, the symbol display areas 210*d*, 210*i*, and 210*n*; and (e) the reel 205*e* is associated with, and configured to display symbols at, the symbol display areas 210*e*, 210*j*, and 210*o*.

The gaming system displays a plurality of paylines 215*a*, 215*b*, and 215*c*, each of which is associated with a different plurality of the symbol display areas. More specifically: (a) the payline 215*a* is associated with the symbol display areas 210*a*, 210*b*, 210*c*, 210*d*, and 210*e*; (b) the payline 215*b* is associated with the symbol display areas 210*f*, 210*g*, 210*h*, 210*i*, and 210*j*; and (c) the payline 215*c* is associated with the symbol display areas 210*k*, 210*l*, 210*m*, 210*n*, and 210*o*.

The gaming system also displays: (a) a message box 260 in which the gaming system displays a variety of messages or indications before, during, or after play of the slot game; (b) a plurality of meters including: (i) a credit meter 270 in which the gaming system displays the player's credit balance (in credit or currency form), (ii) a wager or bet meter 280 that displays any wager or bet placed on a play of the slot game (in credit or currency form), and (iii) an award meter 290 that displays any awards won for the play of the slot game (in credit or currency form); and (c) a Spin button 294 that, when actuated by the player, causes the gaming system to initiate a play of the slot game. While in this illustrated example embodiment the gaming system indicates the players credit balance, any wagers, and any awards in the form of amounts of currency, it should be appreciated that such indications may alternatively or additionally be made in the form of amounts of credits.

In this example embodiment, if the displayed outcome of a play of the slot game includes a set of one or more designated peacock symbols that: (a) are each associated with a same one of the shading patterns; (b) are collectively associated with at least a designated quantity of two feather sub-symbols (though the designated quantity may be any other suitable quantity); and (c) are displayed at adjacent symbol display areas along one of the paylines 215*a*, 215*b*, or 215*c*, the gaming system determines an award associated with that set based on: (a) the particular shading pattern associated with the one or more displayed designated peacock symbols of that set, and (b) a quantity of feather sub-symbols that are collectively associated with the one or more displayed designated peacock symbols of that set.

The gaming system displays a designated peacock symbol paytable 250 that displays the award multipliers that the gaming system employs to determine the awards for such sets of one or more displayed designated peacock symbols. Here, different combinations of different quantities of feather sub-symbols and different shading patterns are associated with different award multipliers. For instance, in this example embodiment, if the displayed outcome of a play of the slot game includes a set of one or more designated peacock symbols that are: (a) each associated with the hatched shading pattern, (b) collectively associated with seven feather sub-symbols, and (c) displayed at adjacent symbol display areas along one of the paylines, the gaming system determines an award associated with that set by multiplying the player's wager on the play of the slot game by the 10× award multiplier. In another instance, if the displayed outcome of a play of the slot game includes a set of one or more designated peacock symbols that are: (a) each associated with the cross-hatched shading pattern, (b) collectively associated with thirteen feather sub-symbols, and (c) displayed at adjacent symbol display areas along one of the paylines, the gaming system determines an award associated with that set by multiplying the player's wager on the play of the slot game by the 50× award multiplier.

Figure 2A:
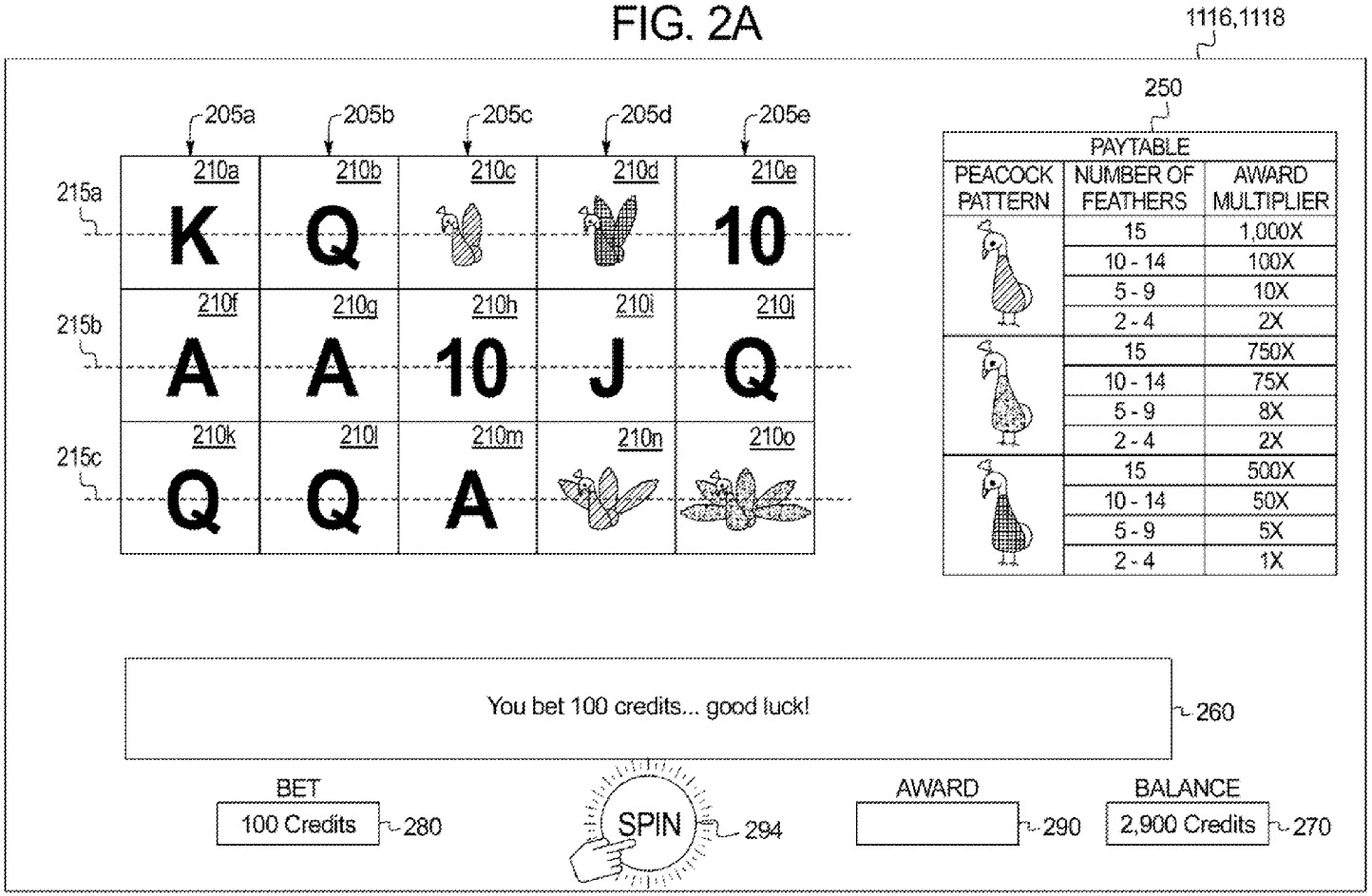
FIGS. 2A, 2B, 2C, 2D, and 2E illustrate screen shots of one example embodiment of the gaming system of the present disclosure providing a plurality of plays of one example embodiment of the game of the present disclosure.
Figure 2B:
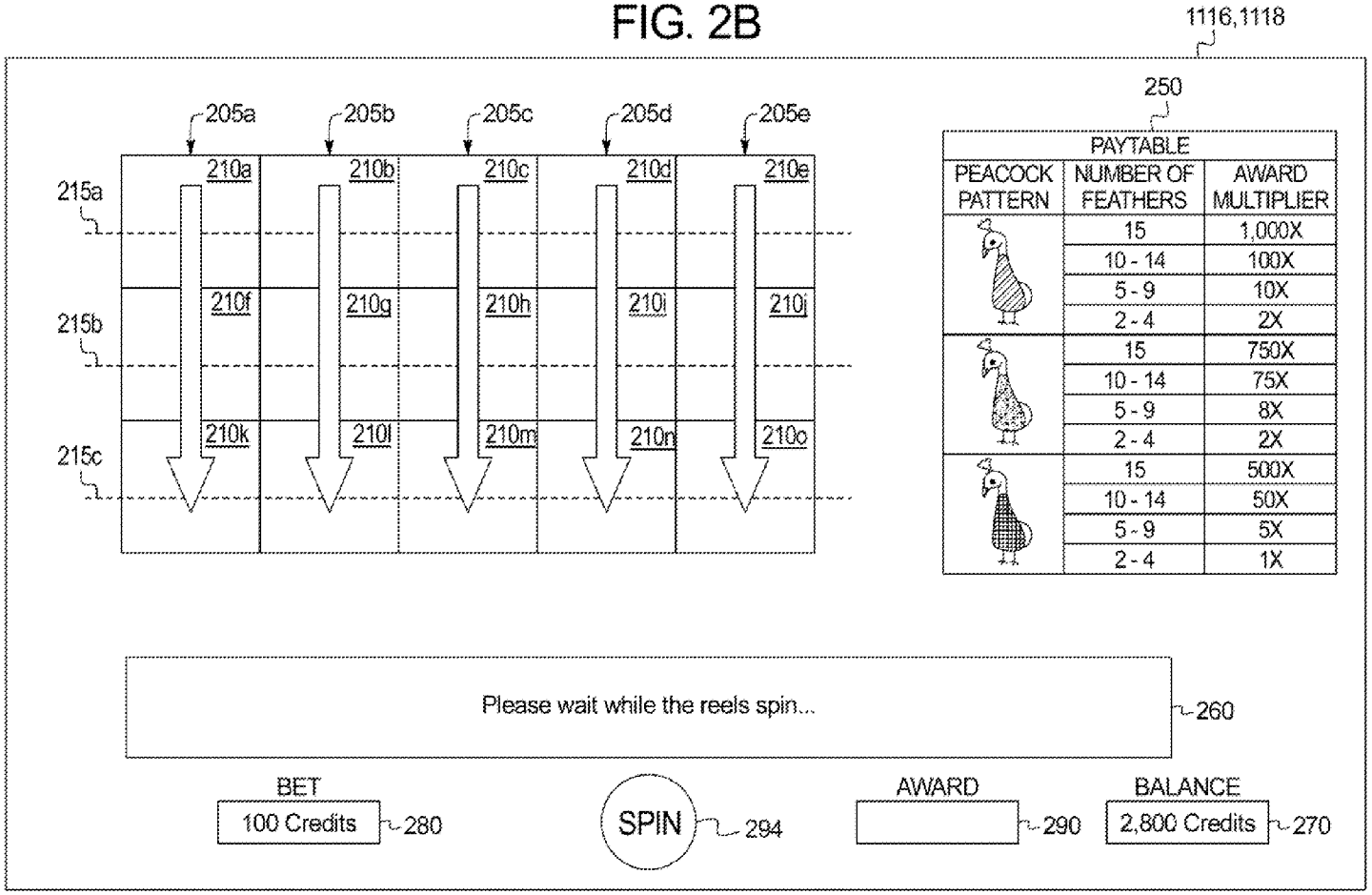

Turning to FIG. 2A, the gaming system receives a wager of 100 credits (as shown in the bet meter 280) and an actuation of the Spin button 294 from the player. Accordingly, the gaming system initiates a play of the slot game and spins the reels 205*a*, 205*b*, 205*c*, 205*d*, and 205*e*. The gaming system displays the following message in the message box 260: "YOU BET 100 CREDITS . . . GOOD LUCK!" As illustrated in FIG. 2B, the gaming system reduces the player's credit balance by the 100 credit wager (as shown in the credit meter 270) and displays the reels 205*a*, 205*b*, 205*c*, 205*d*, and 205*e* spinning. The gaming system displays the following message in the message box 260: "PLEASE WAIT WHILE THE REELS SPIN . . . "

Figure 2C:
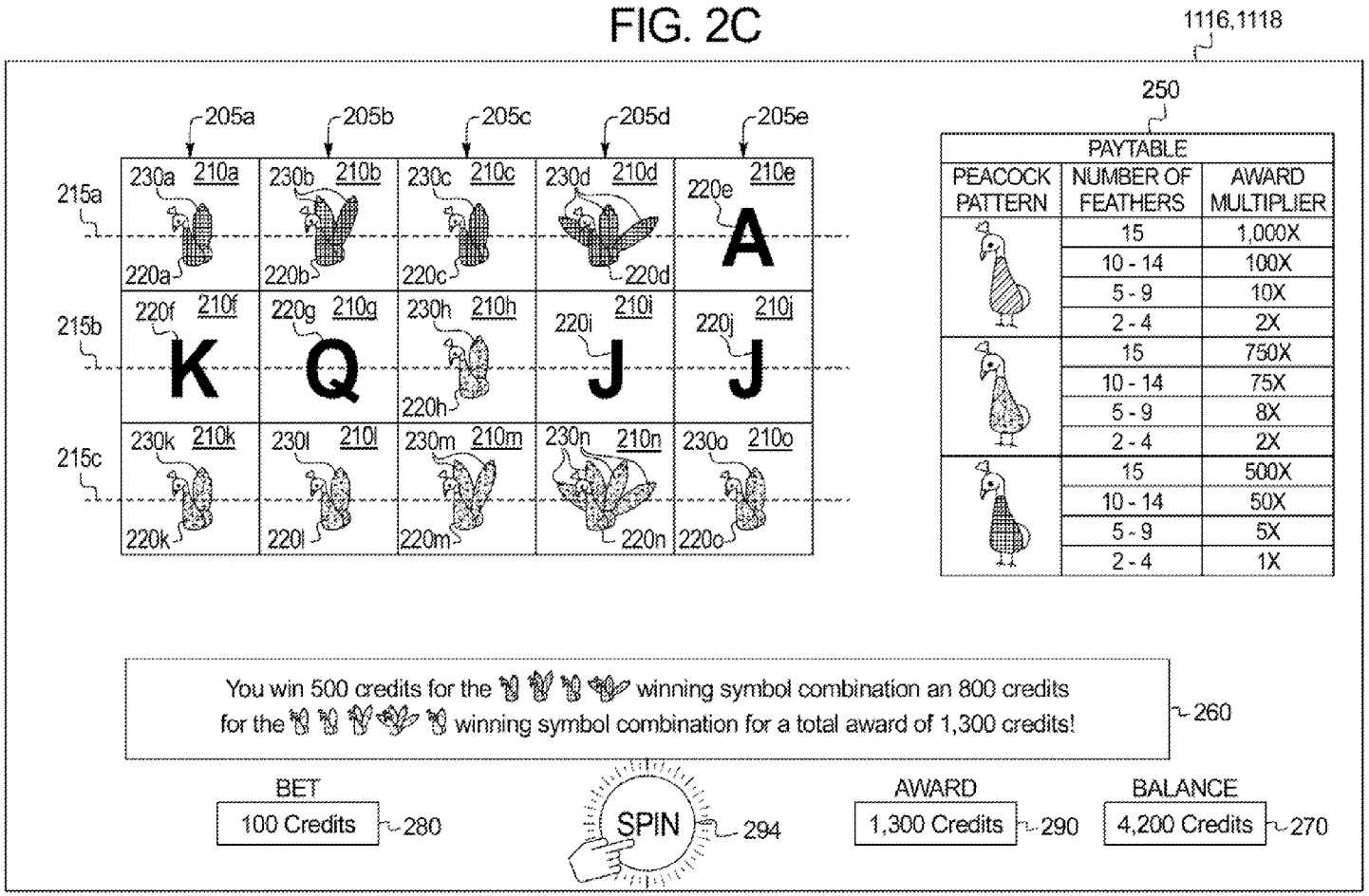

As illustrated in FIG. 2C, the gaming system stops the reels 205*a*, 205*b*, 205*c*, 205*d*, and 205*e* such that: (a) designated peacock symbol 220*a* and feather sub-symbol 230*a* are displayed at the symbol display area 210*a*, (b) designated peacock symbol 220*b* and feather sub-symbols 230*b* are displayed at the symbol display area 210*b*, (c) designated peacock symbol 220*c* and feather sub-symbol 230*c* are displayed at the symbol display area 210*c*, (d) designated peacock symbol 220*d* and feather sub-symbols 230*d* are displayed at the symbol display area 210*d*, (e) non-designated A symbol 220*e* is displayed at the symbol display area 210*e*, (f) non-designated K symbol 220*f* is displayed at the symbol display area 210*f*, (g) non-designated Q symbol 220*g* is displayed at the symbol display area 210*g*, (h) designated peacock symbol 220*h* and feather sub-symbol 230*h* are displayed at the symbol display area 210*h*, (i) non-designated J symbol 220*i* is displayed at the symbol display area 210*i*, (j) non-designated J symbol 220*j* is displayed at the symbol display area 210*j*, (k) designated peacock symbol 220*k* and feather sub-symbol 230*k* are displayed at the symbol display area 210*k*, (l) designated peacock symbol 220*l* and feather sub-symbol 230*l* are displayed at the symbol display area 210*l*, (m) designated peacock symbol 220*m* and feather sub-symbols 230*m* are displayed at the symbol display area 210*m*, (n) designated peacock symbol 220*o* and feather sub-symbols 230*o* are displayed at the symbol display area 210*n*, and (o) designated peacock symbol 220*o* and feather sub-symbol 230*p* are displayed at the symbol display area 210*o*.

With respect to the displayed non-designated symbols, the gaming system determines any awards associated with the displayed non-designated symbols by determining whether any winning combinations of the non-designated symbols included in a non-designated symbols paytable (not shown) associated with the slot game are displayed along any of the wagered-on paylines 215*a*, 215*b*, and/or 215*c*. Here, the gaming system determines that none of the winning combinations of the non-designated symbols are displayed along any of the wagered-on paylines.

With respect to the displayed designated peacock symbols, the gaming system determines whether any sets of one or more designated peacock symbols are: (a) each associated with a same one of the shading patterns; (b) collectively associated with at least two feather sub-symbols; and (c) displayed at adjacent symbol display areas along one of the wagered-on paylines 215*a*, 215*b*, or 215*c*. Here, the gaming system determines: (a) a first such set including the displayed designated peacock symbols 220*a*, 220*b*, 220*c*, and 220*d* that are: (i) each associated with the cross-hatched shading pattern; (ii) collectively associated with seven feather sub-symbols, and (iii) respectively displayed at the adjacent symbol display areas 210*a*, 210*b*, 210*c*, and 210*d* along the wagered-on payline 215*a*; and (b) a second such set including the displayed designated peacock symbols 220*k*, 220*l*, 220*m*, 220*n*, and 220*o*, that are: (i) each associated with the dotted shading pattern; (ii) collectively associated with nine feather sub-symbols; and (iii) respectively displayed at the adjacent symbol display areas 210*k*, 210*l*, 210*m*, 210*n*, and 210*o* along the wagered-on payline 215*c*.

Using the paytable 250, the gaming system determines that the first set is associated with the 5× award multiplier (because the seven feather sub-symbols associated with the displayed designated peacock symbols of the first set are each associated with the cross-hatched shading pattern) and that the second set is associated with the 8× award multiplier (because the nine feather sub-symbols associated with the displayed designated peacock symbols of the first set are each associated with the dotted shading pattern). Accordingly, the gaming system determines: (a) an award of 500 credits associated with the first set by multiplying the player's 100 credit wager by the 5× award multiplier, and (b) an award of 800 credits associated with the second set by multiplying the player's 100 credit wager by the 8× award multiplier for a total award of 1,300 credits. The gaming system displays the total 1,300 credit award in the award meter 290 and updates the player's credit balance to reflect the total 1,300 credit award. The gaming system displays the following message in the message box 260: "YOU WIN 500 CREDITS FOR THE CROSS-HATCHED DESIGNATED PEACOCK SYMBOL WINNING SYMBOL COMBINATION AND 800 CREDITS FOR THE DOTTED DESIGNATED PEACOCK SYMBOL WINNING SYMBOL COMBINATION FOR A TOTAL AWARD OF 1,300 CREDITS!"

Figure 2D:
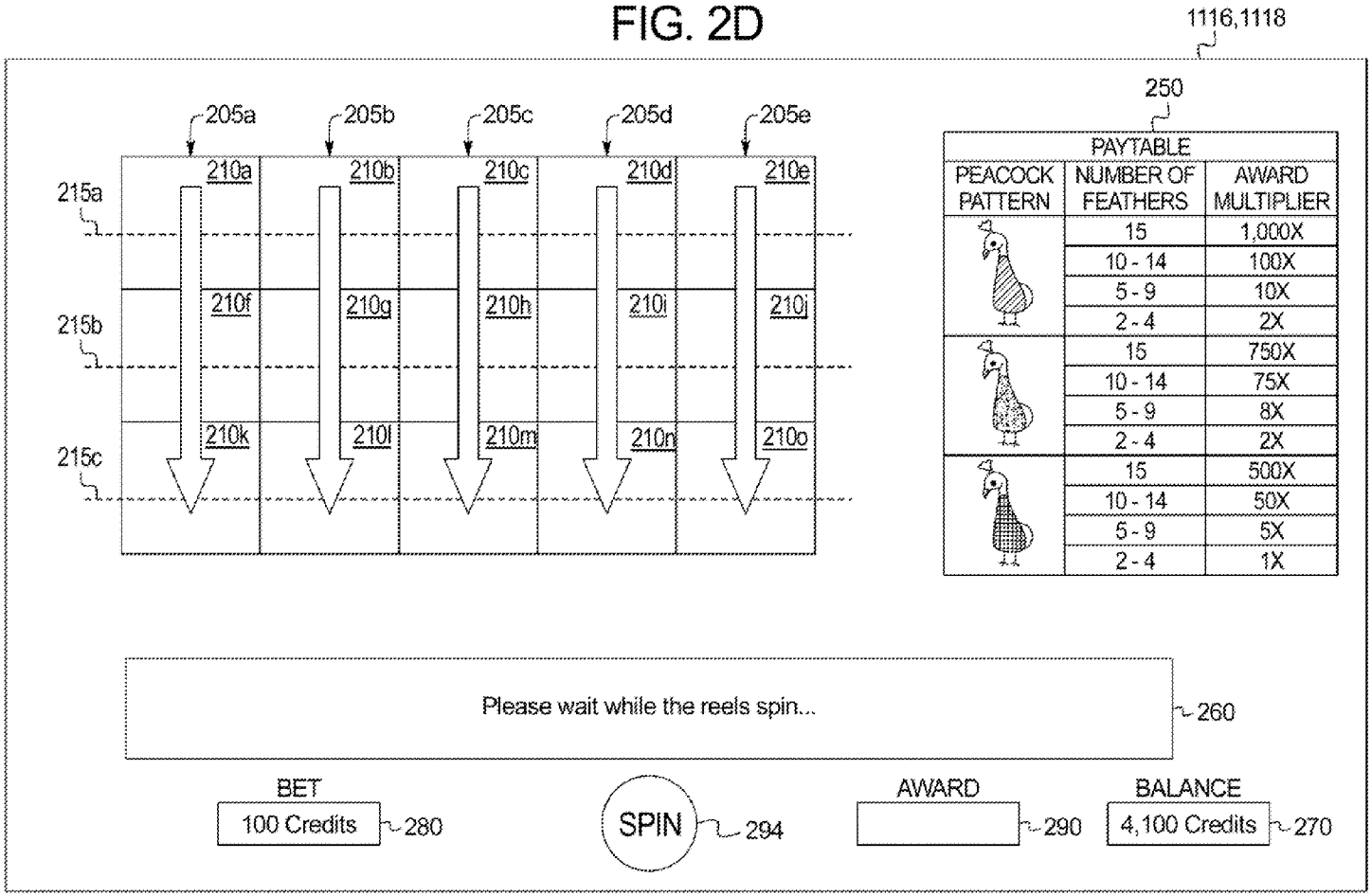

As also illustrated in FIG. 2C, the gaming system receives another actuation of the Spin button 294. Accordingly, the gaming system initiates another play of the slot game and spins the reels 205*a*, 205*b*, 205*c*, 205*d*, and 205*e*. As illustrated in FIG. 2D, the gaming system reduces the player's credit balance by the 100 credit wager (as shown in the credit meter 270) and displays the reels 205*a*, 205*b*, 205*c*, 205*d*, and 205*e* spinning. The gaming system displays the following message in the message box 260: "PLEASE WAIT WHILE THE REELS SPIN . . . "

Figure 2E:
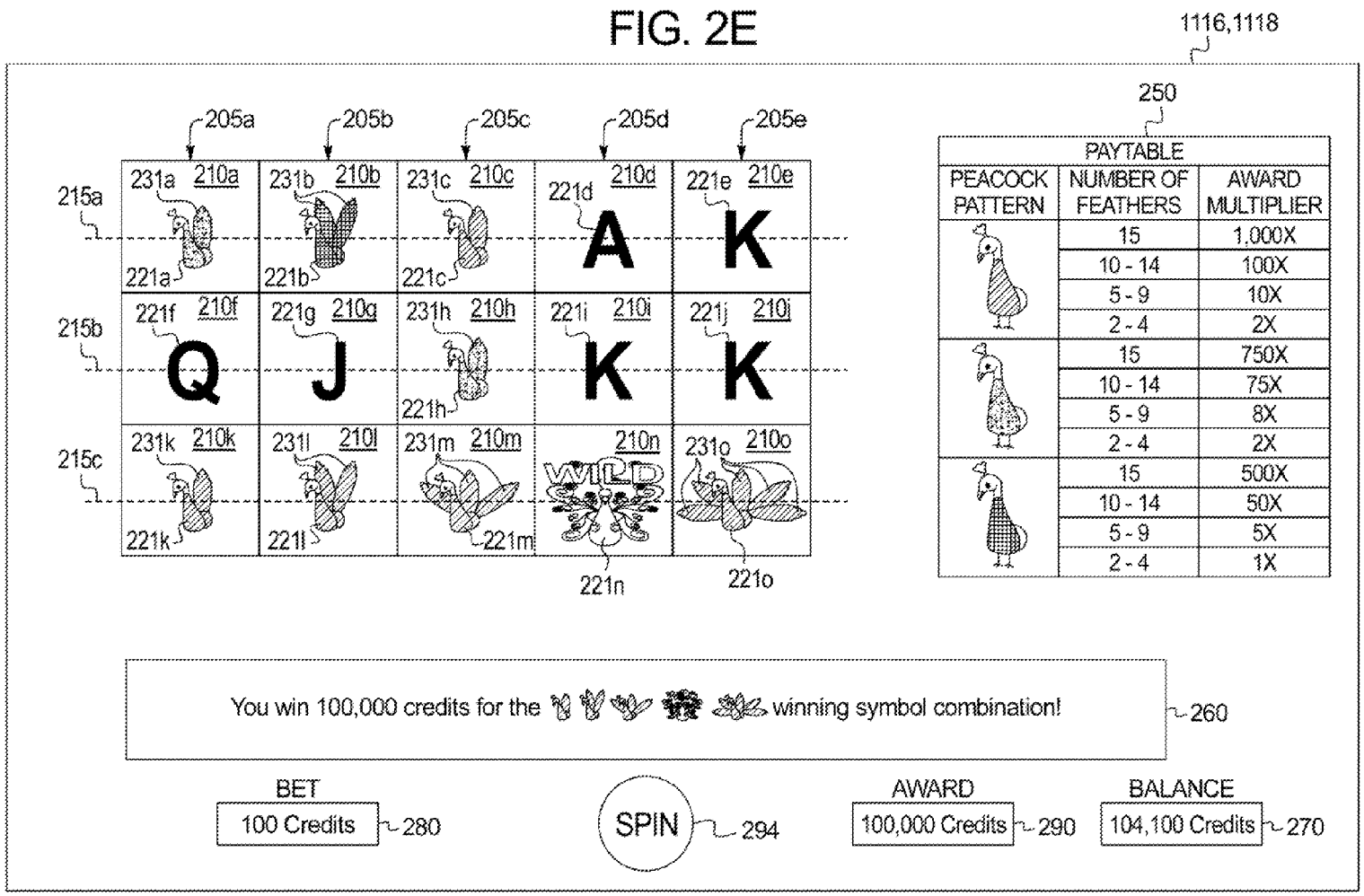

As illustrated in FIG. 2E, the gaming system stops the reels 205*a*, 205*b*, 205*c*, 205*d*, and 205*e* such that: (a) designated peacock symbol 221*a* and feather sub-symbol 231*a* are displayed at the symbol display area 210*a*, (b) designated peacock symbol 221*b* and feather sub-symbols 231*b* are displayed at the symbol display area 210*b*, (c) designated peacock symbol 221*c* and feather sub-symbol 231*c* are displayed at the symbol display area 210*c*, (d) non-designated A symbol 221*d* is displayed at the symbol display area 210*d*, (e) non-designated K symbol 221*e* is displayed at the symbol display area 210*e*, (f) non-designated Q symbol 221*f* is displayed at the symbol display area 210*f*, (g) non-designated J symbol 221*g* is displayed at the symbol display area 210*g*, (h) designated peacock symbol 221*h* and feather sub-symbol 231*h* are displayed at the symbol display area 210*h*, (i) non-designated K symbol 221*i* is displayed at the symbol display area 210*i*, (j) non-designated K symbol 221*j* is displayed at the symbol display area 210*j*, (k) designated peacock symbol 221*k* and feather sub-symbol 231*k* are displayed at the symbol display area 210*k*, (l) designated peacock symbol 221*l* and feather sub-symbols 231*l* are displayed at the symbol display area 210*l*, (m) designated peacock symbol 221*m* and feather sub-symbols 231*m* are displayed at the symbol display area 210*m*, (n) Wild symbol 221*o* is displayed at the symbol display area 210*n*, and (o) designated peacock symbol 221*o* and feather sub-symbols 231*p* are displayed at the symbol display area 210*o*.

With respect to the displayed non-designated symbols, the gaming system determines any awards associated with the displayed non-designated symbols by determining whether any of the winning combinations of the non-designated symbols are displayed along any of the wagered-on paylines 215*a*, 215*b*, and/or 215*c*. Here, the gaming system determines that none of the winning combinations of the non-designated symbols are displayed along any of the wagered-on paylines.

With respect to the displayed designated peacock symbols, the gaming system determines whether any sets of one or more designated peacock symbols are: (a) each associated with a same one of the shading patterns; (b) collectively associated with at least two feather sub-symbols; and (c) displayed at adjacent symbol display areas along one of the wagered-on paylines 215*a*, 215*b*, or 215*c*. Here, the gaming system determines one such set including the displayed designated peacock symbols 221*k*, 221*l*, 221*m*, and 221*o* and the displayed Wild symbol 221*n* that are: (a) each associated with the hatched shading pattern; (b) collectively associated with fifteen feather sub-symbols; and (c) respectively displayed at the adjacent symbol display areas 210*k*, 210*l*, 210*m*, 210*n*, and 210*o* along the wagered-on payline 215*c*. It should be appreciated that, in this instance, the Wild symbol 221*n* represents a designated peacock symbol associated with four feather sub-symbols (i.e., the maximum quantity of feather sub-symbols associated with the reel 205*d* with which the Wild symbol 221*n* is associated) and associated with the hatched shading pattern (i.e., the shading patter resulting in the largest award for this play of the slot game).

Using the paytable 250, the gaming system determines that the set is associated with the 1,000× award multiplier (because the fifteen feather sub-symbols associated with the displayed designated peacock symbols of the set are each associated with the hatched shading pattern). Accordingly, the gaming system determines an award of 100,000 credits associated with the set by multiplying the player's 100 credit wager by the 1,000× award multiplier. The gaming system displays the 100,000 credit award in the award meter 290 and updates the player's credit balance to reflect the 100,000 credit award. The gaming system displays the following message in the message box 260: "YOU WIN 100,000 CREDITS FOR THE HATCHED DESIGNATED PEACOCK SYMBOL WINNING SYMBOL COMBINATION!"

In other embodiments: (a) the designated symbols are not associated with any of the characteristics; and (b) for each designated symbol, all sub-symbols associated with that designated symbol are associated with a same one of the characteristics. In these embodiments, if at least one set of one or more designated symbols that are collectively associated with at least a designated quantity of sub-symbols associated with the same characteristic is displayed, for each such set, the gaming system determines and displays an award associated with that set based on: (a) the particular characteristic associated with the sub-symbols associated with the one or more displayed designated symbols of that set, and (b) a quantity of sub-symbols that are collectively associated with the one or more displayed designated of that set.

In another embodiment, for each reel, each designated symbol associated with that reels is associated with the maximum quantity of sub-symbols associated with that reel. For instance, in one example embodiment, if a first reel is associated with a maximum quantity of one sub-symbol, a second reel is associated with a maximum quantity of two sub-symbols, and a third reels is associated with a maximum quantity of three sub-symbols: (a) each designated symbol associated with the first reel is associated with one sub-symbol, (b) each designated symbol associated with the second reel is associated with two sub-symbols, and (c) each designated symbol associated with the third reel is associated with three sub-symbols.

In certain embodiments, the plurality of symbols associated with the slot game does not include any non-designated symbols.

In other embodiments, at least two of the reels are associated with the same maximum quantity of sub-symbols that may be associated with the designated symbols associated with those reels. In one example embodiment, each reel is associated with a maximum quantity of five sub-symbols that may be associated with the designated symbols associated with those reels.

In the example embodiment described above with respect to FIGS. 2A to 2E, the sub-symbol award evaluation is payline-based in that the designated symbols of a particular set must be displayed at adjacent symbol display areas along a payline. It should be appreciated that, in other embodiments, the gaming system may evaluate the sub-symbols in accordance with any other suitable type of award evaluation instead of or in addition to a payline-based sub-symbol award evaluation. For instance, in various embodiments, the gaming system employs a scatter pay sub-symbol award evaluation instead of or in addition to a payline-based sub-symbol award evaluation. In one example embodiment, the set may include any designated symbols displayed at any symbol display areas. In other embodiments, the gaming system employs a ways-to-win sub-symbol award evaluation (described below) instead of or in addition to a payline-based sub-symbol award evaluation.

Award Evaluation Based on Quantities of Sub-Symbols

Generally, in various embodiments, if an outcome of a play of the game includes a set of one or more displayed designated symbols that are collectively associated with a quantity of sub-symbols that is at least a designated quantity, the gaming system determines an award based on that particular quantity of sub-symbols. Put differently, in these embodiments, the determined award varies based on the particular quantity of sub-symbols collectively associated with those displayed designated symbols.

Figure 3:
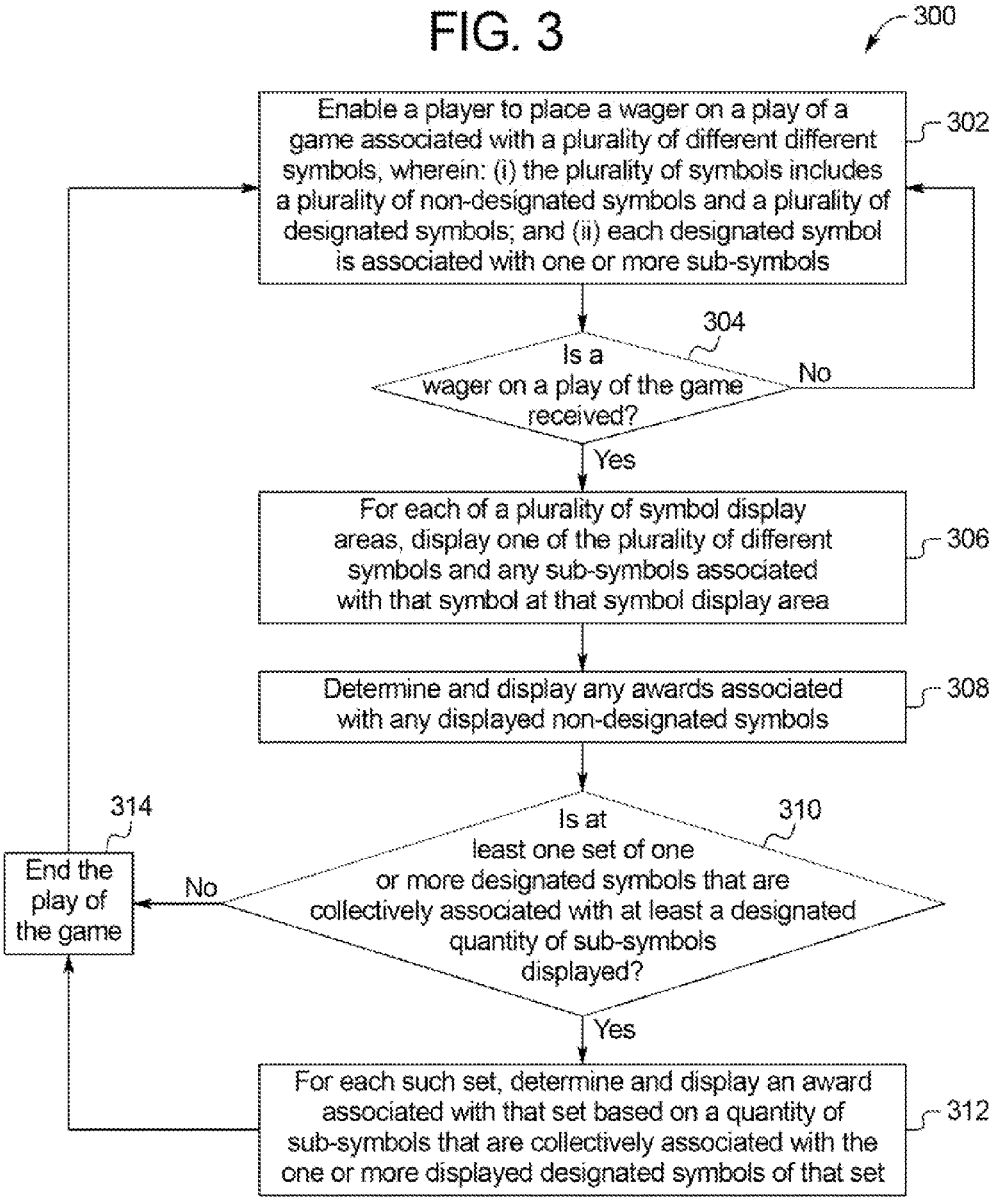
FIG. 3 is a flowchart illustrating an example method of operating another embodiment of the gaming system of the present disclosure.

FIG. 3 illustrates a flowchart of an example process or method 300 of operating another embodiment of the gaming system of the present disclosure. In various embodiments, the process 300 is represented by a set of instructions stored in one or more memories and executed by one or more processors. Although the process 300 is described with reference to the flowchart shown in FIG. 3, it should be appreciated that many other processes of performing the acts associated with this illustrated process 300 may be employed. For example, the order of certain of the illustrated blocks and/or diamonds may be changed, certain of the illustrated blocks and/or diamonds may be optional, and/or certain of the illustrated blocks and/or diamonds may not be employed.

In operation of this example embodiment, the gaming system enables a player to place a wager on a play of a game associated with a plurality of different symbols, as indicated by block 302. In this example embodiment: (a) the plurality of different symbols includes a plurality of non-designated symbols and a plurality of designated symbols; and (b) each designated symbol is associated with one or more sub-symbols. The gaming system determines whether a wager on a play of the game was received, as indicated by diamond 304. If the gaming system determines that a wager on a play of the game was not received, the process 300 returns to block 302.

If, on the other hand, the gaming system determines that a wager on a play of the game was received, for a play of the game, for each of a plurality of symbol display areas, the gaming system displays one of the plurality of different symbols and any sub-symbols associated with that symbol at that symbol display area, as indicated by block 306. The gaming system determines and displays any awards associated with any displayed non-designated symbols, as indicated by block 308. The gaming system determines if at least one set of one or more designated symbols that are collectively associated with at least a designated quantity of sub-symbols is displayed, as indicated by diamond 310.

If the gaming system determines that at least one such set of one or more designated symbols is not displayed, the gaming system ends the play of the game, as indicated by block 314, and the process 300 returns to block 302. If, on the other hand, the gaming system determines that at least one such set of one or more designated symbols is displayed, for each such set, the gaming system determines and displays an award associated with that set based on a quantity of sub-symbols that are collectively associated with the one or more displayed designated of that set, as indicated by block 312. The gaming system ends the play of the game, as indicated by block 314, and the process 300 returns to block 302.

It should be appreciated that, in this example embodiment, the awards determined by the gaming system for different such sets of one or more displayed designated symbols vary based, at least in part, on the particular quantities of sub-symbols collectively associated with the one or more displayed designated symbols of the sets. For instance, in this example embodiment, the determined award for a particular set is: (a) a first award when the quantity of sub-symbols that are collectively associated with the one or more displayed designated symbols of that set is a first quantity; and (b) a second different award when the quantity of sub-symbols that are collectively associated with the one or more displayed designated symbols of that set is a second different quantity.

It should also be appreciated that, in this example embodiment, the gaming system determines the award for a particular set of one or more displayed designated symbols that are collectively associated with at least a designated quantity of sub-symbols based on a quantity of sub-symbols that are collectively associated with the one or more displayed designated of that set, and not based on a quantity of designated symbols included in that set. For instance, if the designated quantity of sub-symbols is four, in this example embodiment the gaming system determines the same award regardless of whether the set includes one designated symbol associated with four sub-symbols or four designated symbols each associated with one sub-symbol.

In other embodiments, however, the award varies based on the quantity of designated symbols included in the set. For instance, in one example embodiment, the gaming system determines larger awards as the set includes more designated symbols, and vice-versa. In another example embodiment, the gaming system determines larger awards as the set includes fewer designated symbols, and vice-versa.

Figure 4A:
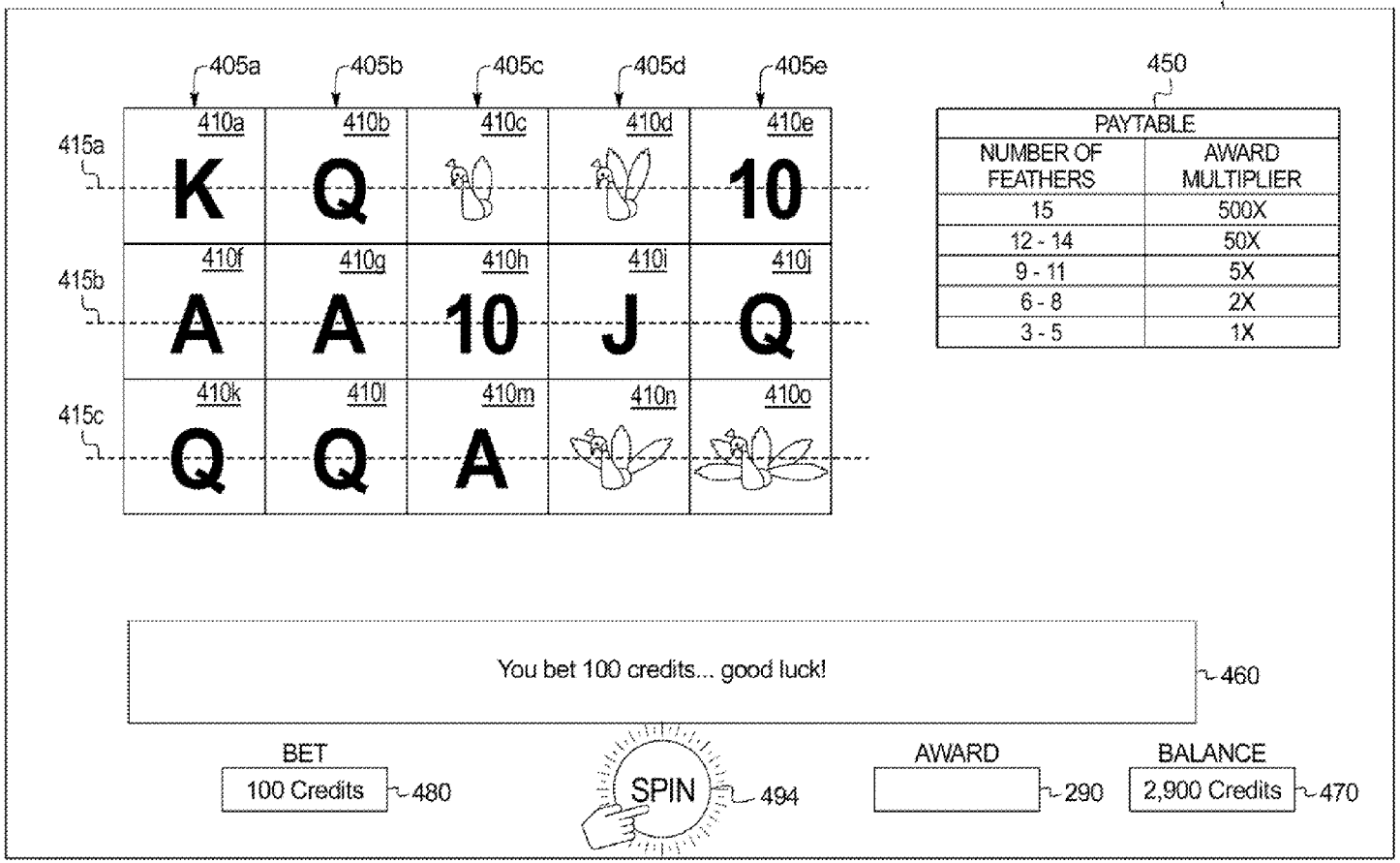
FIGS. 4A, 4B, and 4C illustrate screen shots of another example embodiment of the gaming system of the present disclosure providing a play of another example embodiment of the game of the present disclosure.
Figure 4B:
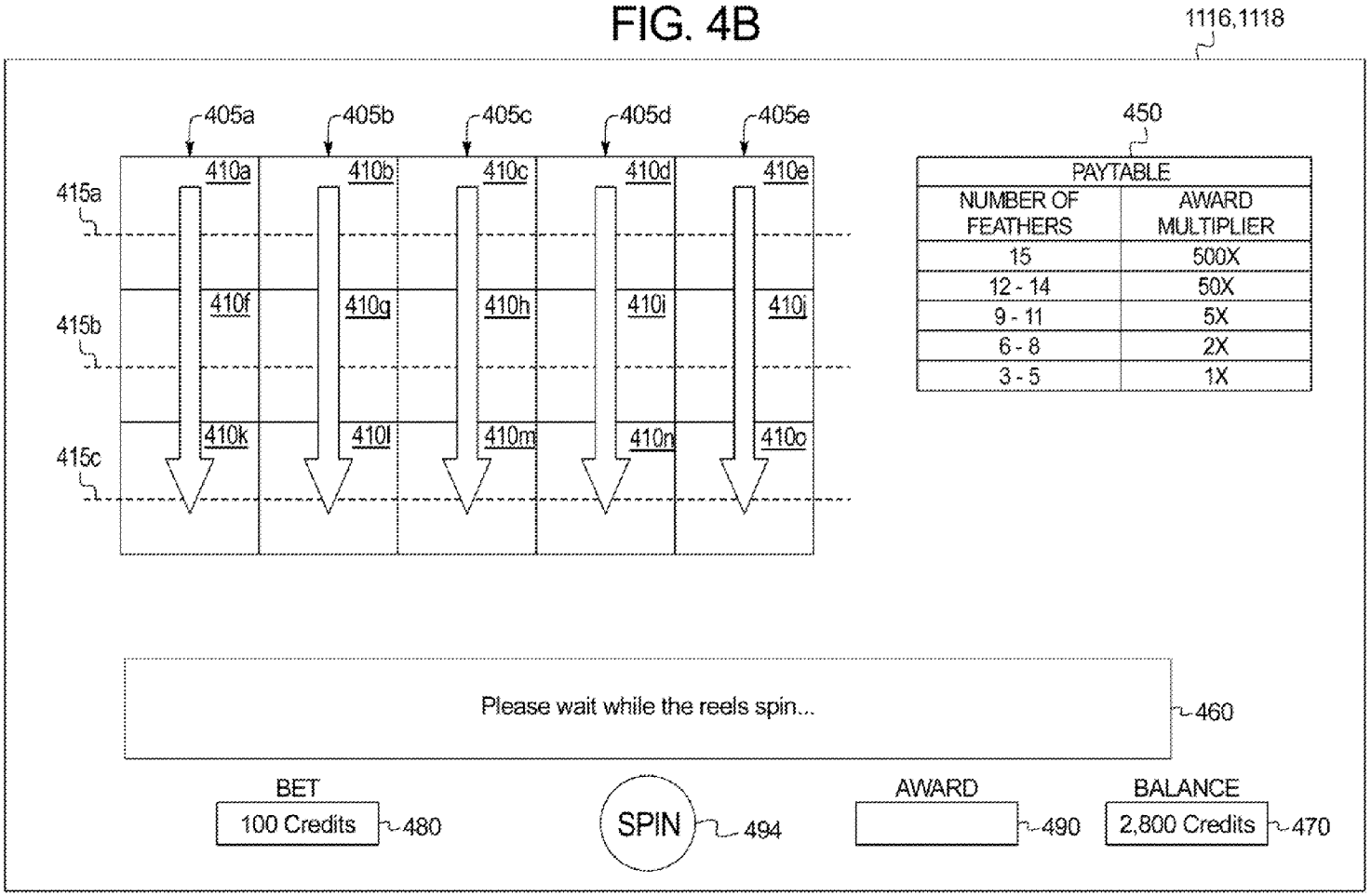
Figure 4C:
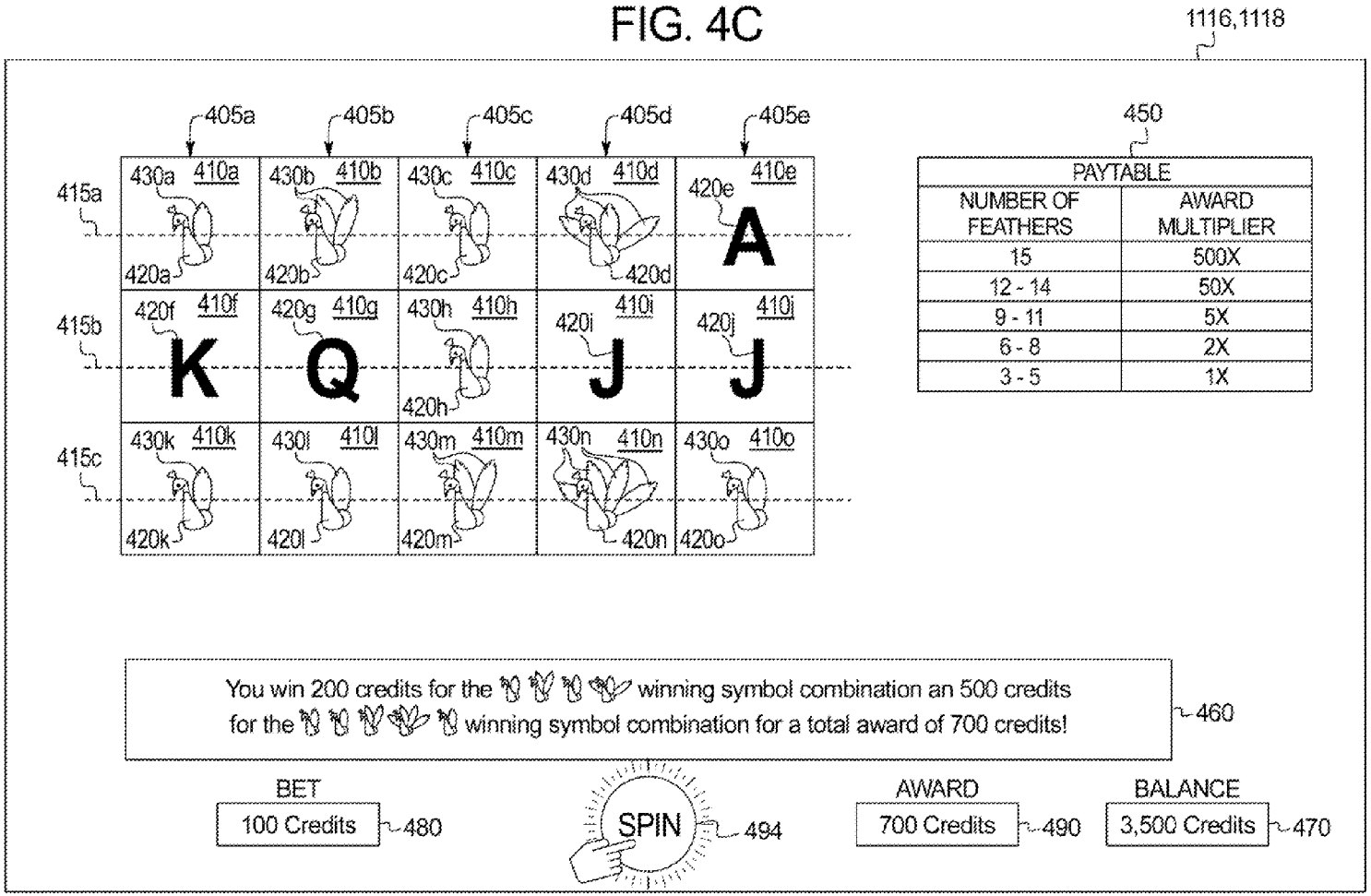

FIGS. 4A, 4B, and 4C illustrate screen shots of another example embodiment of the gaming system of the present disclosure providing a plurality of plays of another example embodiment of the game of the present disclosure. In this example embodiment, the game is a slot game employing a plurality of reels 405*a*, 405*b*, 405*c*, 405*d*, and 405*e*, each of which is associated with a plurality of a plurality of different symbols associated with the slot game. In this example embodiment, the plurality of different symbols associated with the slot game includes a plurality of non-designated symbols and a plurality of designated symbols. In this example embodiment, each designated symbol is associated with a quantity of at least one sub-symbol. In this example embodiment: (a) the designated symbols are peacock symbols, and (b) the sub-symbols are feather sub-symbols. It should thus be appreciated that, in this example embodiment, the plurality of symbols employed for the slot game includes a plurality of non-designated symbols and a plurality of designated peacock symbols associated with different quantities of feather sub-symbols.

In this example embodiment, each reel is associated with a different maximum quantity of feather sub-symbols that may be associated with the designated peacock symbols associated with that reel. Here, the reel 405*a* is associated with a maximum quantity of one feather sub-symbol, the reel 405*b* is associated with a maximum quantity of two feather sub-symbols, the reel 405*c* is associated with a maximum quantity of three feather sub-symbols, the reel 405*d* is associated with a maximum quantity of four feather sub-symbols, and the reel 405*e* is associated with a maximum quantity of five feather sub-symbols. Thus, in this example embodiment: (a) each designated peacock symbol associated with the reel 405*a* is associated with only one feather sub-symbol, (b) each designated peacock symbol associated with the reel 405*b* is associated with at least one but no more than two feather sub-symbols, (c) each designated peacock symbol associated with the reel 405*c* is associated with at least one but no more than three feather sub-symbols, (d) each designated peacock symbol associated with the reel 405*d* is associated with at least one but no more than four feather sub-symbols, and (e) each designated peacock symbol associated with the reel 405*e* is associated with at least one but no more than five feather sub-symbols.

The gaming system displays a plurality of symbol display areas 410*a*, 410*b*, 410*c*, 410*d*, 410*e*, 410*f*, 410*g*, 410*h*, 410*i*, 410*j*, 410*k*, 410*l*, 410*m*, 410*n*, and 410*o* arranged in a 3×5 grid or matrix. The gaming system displays the plurality of reels 405*a*, 405*b*, 405*c*, 405*d*, and 405*e*, each of which is associated with, and configured to display symbols at, a plurality of the symbol display areas. More specifically: (a) the reel 405*a* is associated with, and configured to display symbols at, the symbol display areas 410*a*, 410*f*, and 410*k*; (b) the reel 405*b* is associated with, and configured to display symbols at, the symbol display areas, 410*b*, 410*g*, and 410*l*; (c) the reel 405*c* is associated with, and configured to display symbols at, the symbol display areas 410*c*, 410*h*, and 410*m*; (d) the reel 405*d* is associated with, and configured to display symbols at, the symbol display areas 410*d*, 410*i*, and 410*n*; and (e) the reel 405*e* is associated with, and configured to display symbols at, the symbol display areas 410*e*, 410*j*, and 410*o*.

The gaming system displays a plurality of paylines 415*a*, 415*b*, and 415*c*, each of which is associated with a different plurality of the symbol display areas. More specifically: (a) the payline 415*a* is associated with the symbol display areas 410*a*, 410*b*, 410*c*, 410*d*, and 410*e*; (b) the payline 415*b* is associated with the symbol display areas 410*f*, 410*g*, 410*h*, 410*i*, and 410*j*; and (c) the payline 415*c* is associated with the symbol display areas 410*k*, 410*l*, 410*m*, 410*n*, and 410*o*.

The gaming system also displays: (a) a message box 460 (described above); (b) a plurality of meters including: (i) a credit meter 470 (described above), (ii) a wager or bet meter 480 (described above), and (iii) an award meter 490 (described above); and (c) a Spin button 494 (described above)

In this example embodiment, if the displayed outcome of a play of the slot game includes a set of one or more designated peacock symbols that are: (a) collectively associated with at least a designated quantity of three feather sub-symbols (though the designated quantity may be any other suitable quantity); and (b) displayed at adjacent symbol display areas along one of the paylines 415*a*, 415*b*, or 415*c*, the gaming system determines an award associated with that set based on a quantity of feather sub-symbols that are collectively associated with the one or more displayed designated peacock symbols of that set.

The gaming system displays a designated peacock symbol paytable 450 that displays the award multipliers that the gaming system employs to determine the awards for such sets of one or more displayed designated peacock symbols. Here, different quantities of feather sub-symbols are associated with different award multipliers. For instance, in this example embodiment, if the displayed outcome of a play of the slot game includes a set of one or more designated peacock symbols that are: (a) collectively associated with seven feather sub-symbols, and (b) displayed at adjacent symbol display areas along one of the paylines, the gaming system determines an award associated with that set by multiplying the player's wager on the play of the slot game by the 2× award multiplier. In another instance, if the displayed outcome of a play of the slot game includes a set of one or more designated peacock symbols that are: (a) collectively associated with thirteen feather sub-symbols, and (b) displayed at adjacent symbol display areas along one of the paylines, the gaming system determines an award associated with that set by multiplying the player's wager on the play of the slot game by the 50× award multiplier.

Turning to FIG. 4A, the gaming system receives a wager of 100 credits (as shown in the bet meter 480) and an actuation of the Spin button 494 from the player. Accordingly, the gaming system initiates a play of the slot game and spins the reels 405*a*, 405*b*, 405*c*, 405*d*, and 405*e*. The gaming system displays the following message in the message box 460: "YOU BET 100 CREDITS . . . GOOD LUCK!" As illustrated in FIG. 4B, the gaming system reduces the player's credit balance by the 100 credit wager (as shown in the credit meter 470) and displays the reels 405*a*, 405*b*, 405*c*, 405*d*, and 405*e* spinning. The gaming system displays the following message in the message box 460: "PLEASE WAIT WHILE THE REELS SPIN . . . "

As illustrated in FIG. 4C, the gaming system stops the reels 405*a*, 405*b*, 405*c*, 405*d*, and 405*e* such that: (a) designated peacock symbol 420*a* and feather sub-symbol 430*a* are displayed at the symbol display area 410*a*, (b) designated peacock symbol 420*b* and feather sub-symbols 430*b* are displayed at the symbol display area 410*b*, (c) designated peacock symbol 420*c* and feather sub-symbol 430*c* are displayed at the symbol display area 410*c*, (d) designated peacock symbol 420*d* and feather sub-symbols 430*d* are displayed at the symbol display area 410*d*, (e) non-designated A symbol 420*e* is displayed at the symbol display area 410*e*, (f) non-designated K symbol 420*f* is displayed at the symbol display area 410*f*, (g) non-designated Q symbol 420*g* is displayed at the symbol display area 410*g*, (h) designated peacock symbol 420*h* and feather sub-symbol 430*h* are displayed at the symbol display area 410*h*, (i) non-designated J symbol 420*i* is displayed at the symbol display area 410*i*, (j) non-designated J symbol 420*j* is displayed at the symbol display area 410*j*, (k) designated peacock symbol 420*k* and feather sub-symbol 430*k* are displayed at the symbol display area 410*k*, (l) designated peacock symbol 420*l* and feather sub-symbol 430*l* are displayed at the symbol display area 410*l*, (m) designated peacock symbol 420*m* and feather sub-symbols 430*m* are displayed at the symbol display area 410*m*, (n) designated peacock symbol 420*o* and feather sub-symbols 430*o* are displayed at the symbol display area 410*n*, and (o) designated peacock symbol 420*o* and feather sub-symbol 430*p* are displayed at the symbol display area 411*o*.

With respect to the displayed non-designated symbols, the gaming system determines any awards associated with the displayed non-designated symbols by determining whether any winning combinations of the non-designated symbols included in a non-designated symbols paytable (not shown) associated with the slot game are displayed along any of the wagered-on paylines 415*a*, 415*b*, and/or 415*c*. Here, the gaming system determines that none of the winning combinations of the non-designated symbols are displayed along any of the wagered-on paylines.

With respect to the displayed designated peacock symbols, the gaming system determines whether any sets of one or more designated peacock symbols are: (a) collectively associated with at least three feather sub-symbols; and (b) displayed at adjacent symbol display areas along one of the wagered-on paylines 415*a*, 415*b*, or 415*c*. Here, the gaming system determines: (a) a first such set including the displayed designated peacock symbols 420*a*, 420*b*, 420*c*, and 420*d* that are: (i) collectively associated with seven feather sub-symbols; and (ii) respectively displayed at the adjacent symbol display areas 410*a*, 410*b*, 410*c*, and 410*d* along the wagered-on payline 415*a*; and (b) a second such set including the displayed designated peacock symbols 420*k*, 420*l*, 420*m*, 420*n*, and 420*o*, that are: (i) collectively associated with nine feather sub-symbols; and (ii) respectively displayed at the adjacent symbol display areas 410*k*, 410*l*, 410*m*, 410*n*, and 410*o* along the wagered-on payline 415*c*.

Using the paytable 450, the gaming system determines that the first set is associated with the 2× award multiplier (because the displayed designated peacock symbols of the first set are collectively associated with seven feather sub-symbols) and that the second set is associated with the 5× award multiplier (because the displayed designated peacock symbols of the second set are collectively associated with nine feather sub-symbols). Accordingly, the gaming system determines: (a) an award of 200 credits associated with the first set by multiplying the player's 100 credit wager by the 2× award multiplier, and (b) an award of 500 credits associated with the second set by multiplying the player's 100 credit wager by the 5× award multiplier for a total award of 700 credits. The gaming system displays the total 700 credit award in the award meter 490 and updates the players credit balance to reflect the total 700 credit award. The gaming system displays the following message in the message box 460: "YOU WIN 200 CREDITS FOR THE DESIGNATED PEACOCK SYMBOL WINNING SYMBOL COMBINATION ALONG THE TOP PAYLINE AND 500

CREDITS FOR THE DESIGNATED PEACOCK SYMBOL WINNING SYMBOL COMBINATION ALONG THE BOTTOM PAYLINE FOR A TOTAL AWARD OF 700 CREDITS!"

In the example embodiment described above with respect to FIGS. 4A to 4C, the sub-symbol award evaluation is payline-based in that the designated symbols of a particular set must be displayed at adjacent symbol display areas along a payline. It should be appreciated that, in other embodiments, the gaming system may evaluate the sub-symbols in accordance with any other suitable type of award evaluation instead of or in addition to a payline-based sub-symbol award evaluation. For instance, in various embodiments, the gaming system employs a scatter pay sub-symbol award evaluation instead of or in addition to a payline-based sub-symbol award evaluation. In one example embodiment, the set may include any designated symbols displayed at any symbol display areas. In other embodiments, the gaming system employs a ways-to-win sub-symbol award evaluation (described below) instead of or in addition to a payline-based sub-symbol award evaluation.

Award Evaluation Based on Quantities of Sub-Symbols and Sub-Symbol Characteristics Generally, in various embodiments, if an outcome of a play of the game includes a set of one or more displayed designated symbols that are collectively associated with a quantity of sub-symbols that is at least a designated quantity, the gaming system determines an award based on the characteristic(s) associated with the sub-symbols associated with those displayed designated symbols and that particular quantity of sub-symbols. Put differently, in these embodiments, the determined award varies based on the particular characteristics associated with the sub-symbols associated with those displayed designated symbols and/or the particular quantities of sub-symbols collectively associated with those displayed designated symbols.

Figure 5:
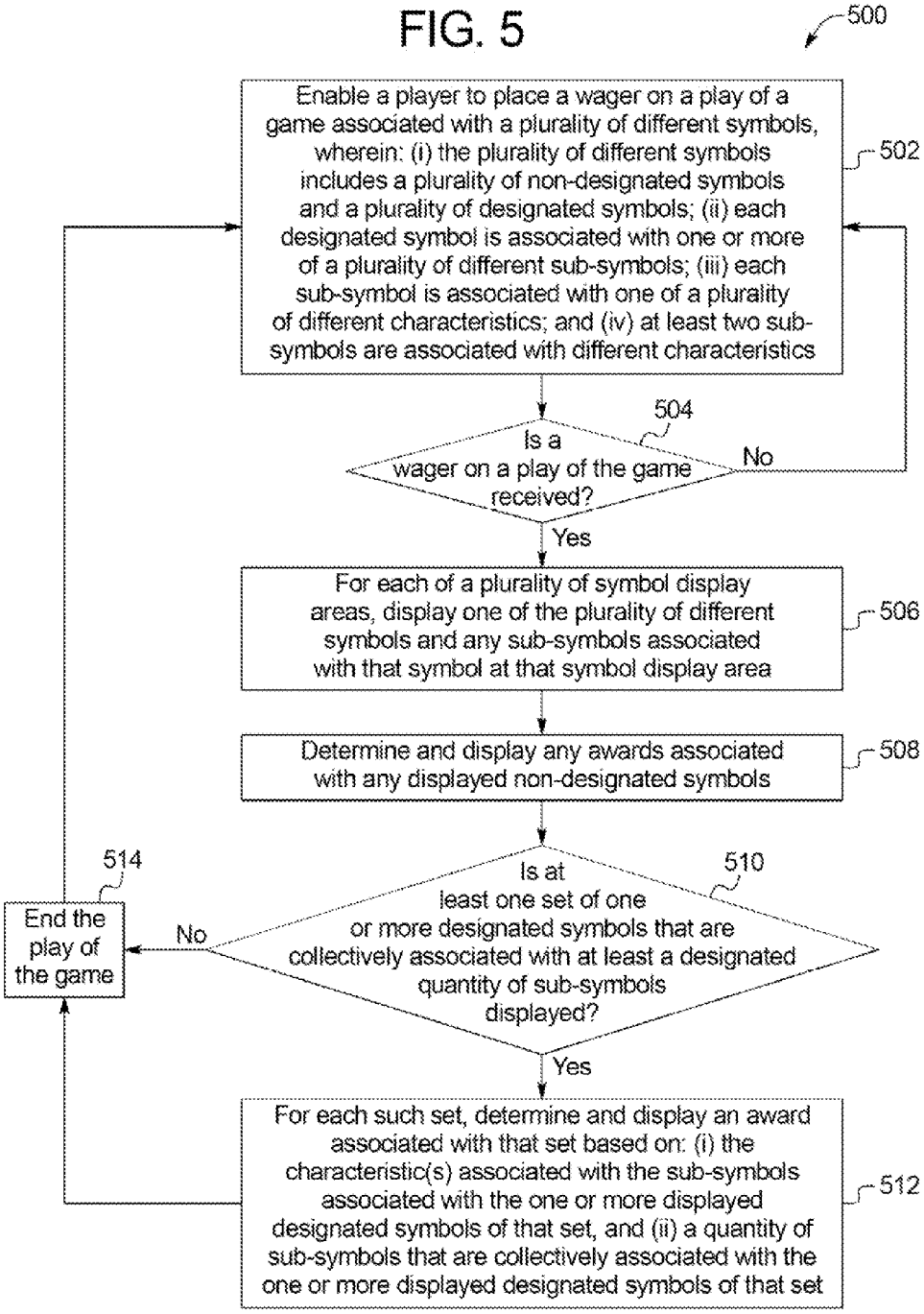
FIG. 5 is a flowchart illustrating an example method of operating another embodiment of the gaming system of the present disclosure.

FIG. 5 illustrates a flowchart of an example process or method 500 of operating another embodiment of the gaming system of the present disclosure. In various embodiments, the process 500 is represented by a set of instructions stored in one or more memories and executed by one or more processors. Although the process 500 is described with reference to the flowchart shown in FIG. 5, it should be appreciated that many other processes of performing the acts associated with this illustrated process 500 may be employed. For example, the order of certain of the illustrated blocks and/or diamonds may be changed, certain of the illustrated blocks and/or diamonds may be optional, and/or certain of the illustrated blocks and/or diamonds may not be employed.

In operation of this example embodiment, the gaming system enables a player to place a wager on a play of a game associated with a plurality of different symbols, as indicated by block 502. In this example embodiment: (a) the plurality of different symbols includes a plurality of non-designated symbols and a plurality of designated symbols, (b) each designated symbol is associated with one or more of a plurality of different sub-symbols, (c) each sub-symbol is associated with one of a plurality of different characteristics, and (d) at least two sub-symbols are associated with different characteristics. The gaming system determines whether a wager on a play of the game was received, as indicated by diamond 504. If the gaming system determines that a wager on a play of the game was not received, the process 500 returns to block 502.

If, on the other hand, the gaming system determines that a wager on a play of the game was received, for a play of the game, for each of a plurality of symbol display areas, the gaming system displays one of the plurality of different symbols and any sub-symbols associated with that symbol at that symbol display area, as indicated by block 506. The gaming system determines and displays any awards associated with any displayed non-designated symbols, as indicated by block 508. The gaming system determines if at least one set of one or more designated symbols that are collectively associated with at least a designated quantity of sub-symbols is displayed, as indicated by diamond 510.

If the gaming system determines that at least one such set of one or more designated symbols is not displayed, the gaming system ends the play of the game, as indicated by block 514, and the process 500 returns to block 502. If, on the other hand, the gaming system determines that at least one such set of one or more designated symbols is displayed, for each such set, the gaming system determines and displays an award associated with that set based on: (a) the characteristic(s) associated with the sub-symbols associated with the one or more displayed designated symbols of that set, and (b) a quantity of sub-symbols that are collectively associated with the one or more displayed designated symbols of that set, as indicated by block 512. The gaming system ends the play of the game, as indicated by block 514, and the process 500 returns to block 502.

It should be appreciated that, in this example embodiment, the awards determined by the gaming system for different such sets of one or more displayed designated symbols vary based, at least in part, on the particular characteristics associated with the sub-symbols associated with the one or more displayed designated symbols of the sets and/or the particular quantities of sub-symbols collectively associated with the one or more displayed designated symbols of the sets.

It should also be appreciated that, in this example embodiment, the gaming system determines the award for a particular set of one or more displayed designated symbols that are collectively associated with at least a designated quantity of sub-symbols based on: (a) the characteristic(s) associated with the sub-symbols associated with the one or more displayed designated symbols of that set, and (b) a quantity of sub-symbols that are collectively associated with the one or more displayed designated symbols of that set, and not based on a quantity of designated symbols included in that set. For instance, if the designated quantity of sub-symbols is four, in this example embodiment the gaming system determines the same award regardless of whether the set includes one designated symbol associated with four sub-symbols or four designated symbols each associated with one sub-symbol.

In other embodiments, however, the award varies based on the quantity of designated symbols included in the set. For instance, in one example embodiment, the gaming system determines larger awards as the set includes more designated symbols, and vice-versa. In another example embodiment, the gaming system determines larger awards as the set includes fewer designated symbols, and vice-versa.

Figure 6A:
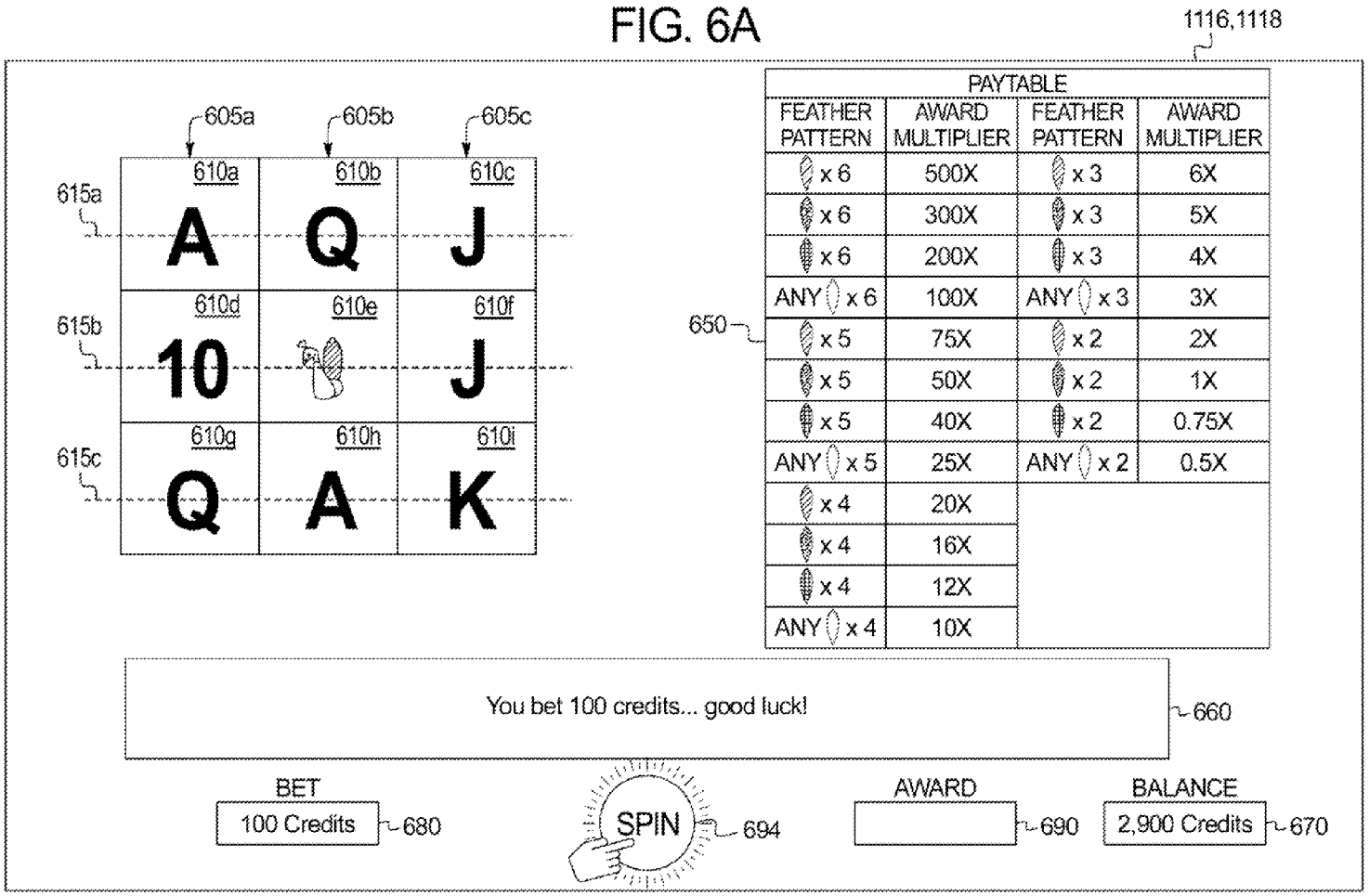
FIGS. 6A, 6B, and 6C illustrate screen shots of another example embodiment of the gaming system of the present disclosure providing a play of another example embodiment of the game of the present disclosure.
Figure 6B:
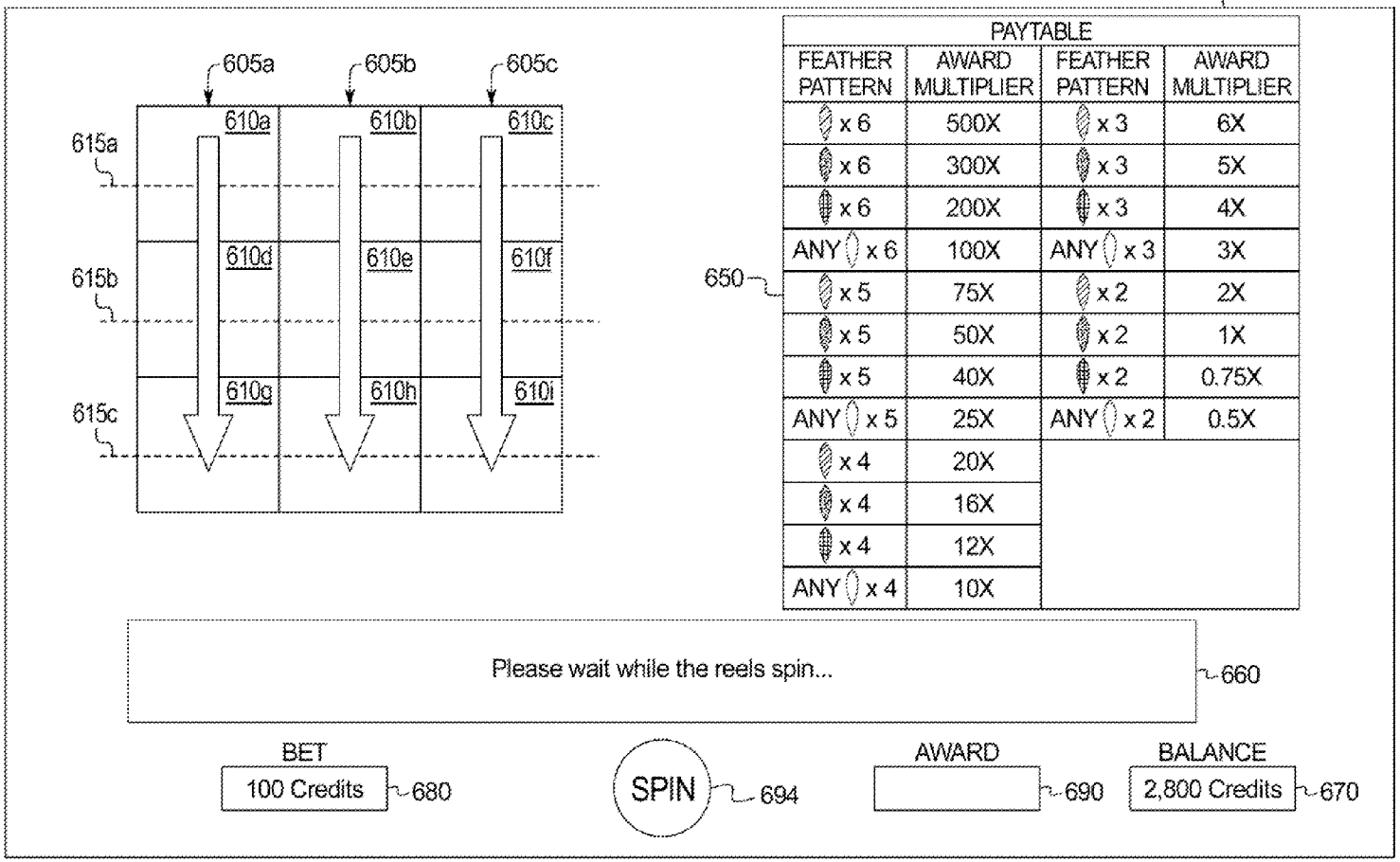
Figure 6C:
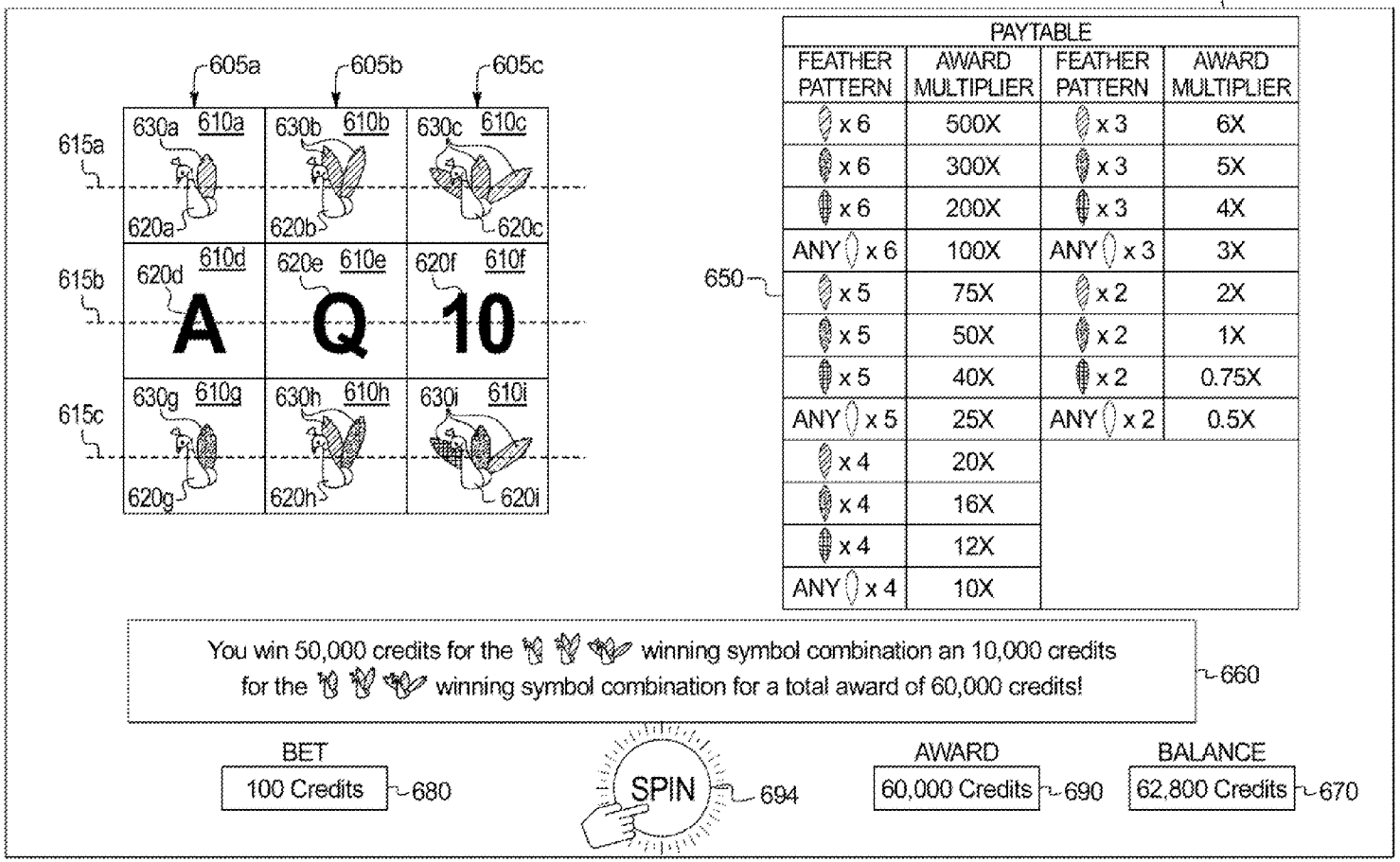

FIGS. 6A, 6B, and 6C illustrate screen shots of another example embodiment of the gaming system of the present disclosure providing a plurality of plays of another example embodiment of the game of the present disclosure. In this example embodiment, the game is a slot game employing a plurality of reels 605*a*, 605*b*, and 605*c*, each of which is associated with a plurality of a plurality of different symbols associated with the slot game. In this example embodiment, the plurality of different symbols associated with the slot game includes a plurality of non-designated symbols and a plurality of designated symbols. In this example embodiment, each designated symbol is associated with a quantity of at least one sub-symbol, and each sub-symbols is associated with one of a plurality of different characteristics. In this example embodiment: (a) the designated symbols are peacock symbols; (b) the sub-symbols are feather sub-symbols; and (c) the plurality of characteristics includes the following three different shading patterns: a hatched shading pattern, a cross-hatched shading pattern, and a dotted shading pattern. It should thus be appreciated that, in this example embodiment, the plurality of symbols employed for the slot game includes a plurality of non-designated symbols and a plurality of designated peacock symbols associated with different quantities of feather sub-symbols associated with different shading patterns.

In this example embodiment, each reel is associated with a different maximum quantity of feather sub-symbols that may be associated with the designated peacock symbols associated with that reel. Here, the reel 605*a* is associated with a maximum quantity of one feather sub-symbol, the reel 605*b* is associated with a maximum quantity of two feather sub-symbols, and the reel 605*c* is associated with a maximum quantity of three feather sub-symbols. Thus, in this example embodiment: (a) each designated peacock symbol associated with the reel 605*a* is associated with only one feather sub-symbol, (b) each designated peacock symbol associated with the reel 605*b* is associated with at least one but no more than two feather sub-symbols, and (c) each designated peacock symbol associated with the reel 605*c* is associated with at least one but no more than three feather sub-symbols The gaming system displays a plurality of symbol display areas 610*a*, 610*b*, 610*c*, 610*d*, 610*e*, 610*f*, 610*g*, 610*h*, and 610*i* arranged in a 3×3 grid or matrix The gaming system displays the plurality of reels 605*a*, 605*b*, and 605*c*, each of which is associated with, and configured to display symbols at, a plurality of the symbol display areas. More specifically: (a) the reel 605*a* is associated with, and configured to display symbols at, the symbol display areas 610*a*, 610*d*, and 610*g*: (b) the reel 605*b* is associated with, and configured to display symbols at, the symbol display areas, 610*b*, 610*e*, and 610*h*; and (c) the reel 605*c* is associated with, and configured to display symbols at, the symbol display areas 610*c*, 610*f*, and 610*i*.

The gaming system displays a plurality of paylines 615*a*, 615*b*, and 615*c*, each of which is associated with a different plurality of the symbol display areas. More specifically: (a) the payline 615*a* is associated with the symbol display areas 610*a*, 610*b*, and 610*c*; (b) the payline 615*b* is associated with the symbol display areas 610*d*, 610*e*, and 610*f*; and (c) the payline 615*c* is associated with the symbol display areas 610*g*, 610*h*, and 610*i*.

The gaming system also displays: (a) a message box 660 (described above); (b) a plurality of meters including: (i) a credit meter 670 (described above), (ii) a wager or bet meter 680 (described above), and (iii) an award meter 690 (described above); and (c) a Spin button 694 (described above)

In this example embodiment, if the displayed outcome of a play of the slot game includes a set of one or more designated peacock symbols that are: (a) collectively associated with at least a designated quantity of two feather sub-symbols (though the designated quantity may be any other suitable quantity); and (b) displayed at adjacent symbol display areas along one of the paylines 615*a*, 615*b*, or 615*c*, the gaming system determines an award associated with that set based on: (a) the characteristic(s) associated with the sub-symbols associated with the one or more displayed designated symbols of that set, and (b) a quantity of sub-symbols that are collectively associated with the one or more displayed designated of that set.

The gaming system displays a designated peacock symbol paytable 650 that displays the award multipliers that the gaming system employs to determine the awards for such sets of one or more displayed designated peacock symbols. Here, different combinations of different quantities of feather sub-symbols are associated with different award multipliers. For instance, in this example embodiment, if the displayed outcome of a play of the slot game includes a set of one or more designated peacock symbols that are: (a) collectively associated with five feather sub-symbols that are associated with at least two different characteristics, and (b) displayed at adjacent symbol display areas along one of the paylines, the gaming system determines an award associated with that set by multiplying the players wager on the play of the slot game by the 25× award multiplier. In another instance, if the displayed outcome of a play of the slot game includes a set of one or more designated peacock symbols that are: (a) collectively associated with four feather sub-symbols that are each associated with the dotted shading pattern, and (b) displayed at adjacent symbol display areas along one of the paylines, the gaming system determines an award associated with that set by multiplying the player's wager on the play of the slot game by the 16× award multiplier.

Turning to FIG. 6A, the gaming system receives a wager of 100 credits (as shown in the bet meter 680) and an actuation of the Spin button 694 from the player. Accordingly, the gaming system initiates a play of the slot game and spins the reels 605*a*, 605*b*, and 605*c*. The gaming system displays the following message in the message box 660: "YOU BET 100 CREDITS . . . GOOD LUCK!" As illustrated in FIG. 6B, the gaming system reduces the player's credit balance by the 100 credit wager (as shown in the credit meter 670) and displays the reels 605*a*, 605*b*, and 605*c* spinning. The gaming system displays the following message in the message box 660: "PLEASE WAIT WHILE THE REELS SPIN . . . "

As illustrated in FIG. 6C, the gaming system stops the reels 605*a*, 605*b*, and 605*c* such that: (a) designated peacock symbol 620*a* and feather sub-symbol 630*a* are displayed at the symbol display area 610*a*, (b) designated peacock symbol 620*b* and feather sub-symbols 630*b* are displayed at the symbol display area 610*b*, (c) designated peacock symbol 620*c* and feather sub-symbols 630*c* are displayed at the symbol display area 610*c*, (d) non-designated A symbol 620*d* is displayed at the symbol display area 610*d*, (e) non-designated Q symbol 620*e* is displayed at the symbol display area 610*e*, (f) non-designated 10 symbol 620*f* is displayed at the symbol display area 610*f*, (g) designated peacock symbol 620*g* and feather sub-symbol 630*g* are displayed at the symbol display area 610*g*, (h) designated peacock symbol 620*h* and feather sub-symbols 630*h* are displayed at the symbol display area 610*h*, and (i) designated peacock symbol 620*i* and feather sub-symbols 630*i* are displayed at the symbol display area 610*i*.

With respect to the displayed non-designated symbols, the gaming system determines any awards associated with the displayed non-designated symbols by determining whether any winning combinations of the non-designated symbols included in a non-designated symbols paytable (not shown) associated with the slot game are displayed along any of the wagered-on paylines 615*a*, 615*b*, and/or 615*c*. Here, the gaming system determines that none of the winning combinations of the non-designated symbols are displayed along any of the wagered-on paylines.

With respect to the displayed designated peacock symbols, the gaming system determines whether any sets of one or more designated peacock symbols are: (a) collectively associated with at least two feather sub-symbols; and (b) displayed at adjacent symbol display areas along one of the wagered-on paylines 615*a*, 615*b*, or 615*c*. Here, the gaming system determines: (a) a first such set including the displayed designated peacock symbols 620*a*, 620*b*, and 620*c* that are: (i) collectively associated with six feather sub-symbols; and (ii) respectively displayed at the adjacent symbol display areas 610*a*, 610*b*, and 610*c* along the wagered-on payline 615*a*; and (b) a second such set including the displayed designated peacock symbols 620*g*, 620*h*, and 620*i* that are: (i) collectively associated with six feather sub-symbols; and (ii) respectively displayed at the adjacent symbol display areas 610*g*, 610*h*, and 610*i* along the wagered-on payline 615*c*.

Using the paytable 650, the gaming system determines that the first set is associated with the 500× award multiplier (because the six feather sub-symbols associated with the displayed designated peacock symbols of the first set are each associated with the same hatched shading pattern) and the second set is associated with the 100× award multiplier (because the six feather sub-symbols associated with the displayed designated peacock symbols of the first set are associated with at least two different shading patterns). Accordingly, the gaming system determines: (a) an award of 50,000 credits associated with the first set by multiplying the player's 100 credit wager by the 500× award multiplier, and (b) an award of 10,000 credits associated with the second set by multiplying the player's 100 credit wager by the 100× award multiplier for a total award of 60,000 credits. The gaming system displays the total 60,000 credit award in the award meter 690 and updates the player's credit balance to reflect the total 60,000 credit award. The gaming system displays the following message in the message box 660: "YOU WIN 50,000 CREDITS FOR THE DESIGNATED PEACOCK SYMBOL WINNING SYMBOL COMBINATION ALONG THE TOP PAYLINE AND 10,000 CREDITS FOR THE DESIGNATED PEACOCK SYMBOL WINNING SYMBOL COMBINATION ALONG THE BOTTOM PAYLINE FOR A TOTAL AWARD OF 60,000 CREDITS!"

It should be appreciated that the paytable may include any suitable combination of sub-symbols associated with the same or different characteristics. For instance, the paytable may include different permutations of sub-symbols associated with differing characteristics, such as a combination including two sub-symbols associated with the hatched shading pattern and three sub-symbols associated with the dotted shading pattern.

In the example embodiment described above with respect to FIGS. 6A to 6C, the sub-symbol award evaluation is payline-based in that the designated symbols of a particular set must be displayed at adjacent symbol display areas along a payline. It should be appreciated that, in other embodiments, the gaming system may evaluate the sub-symbols in accordance with any other suitable type of award evaluation instead of or in addition to a payline-based sub-symbol award evaluation. For instance, in various embodiments, the gaming system employs a scatter pay sub-symbol award evaluation instead of or in addition to a payline-based sub-symbol award evaluation. In one example embodiment, the set may include any designated symbols displayed at any symbol display areas. In other embodiments, the gaming system employs a ways-to-win sub-symbol award evaluation (described below) instead of or in addition to a payline-based sub-symbol award evaluation.

Other Embodiments

In various embodiments, the gaming system employs the slot game as a free spin bonus game. In certain such embodiments, for a play of the free spin bonus game, the gaming system employs a set of symbols in which each designated symbol is associated with a same maximum bonus quantity of feather sub-symbols, regardless of the particular reel with which that designated symbol is associated. In one embodiment, the maximum bonus quantity of feather sub-symbols is equal to the largest maximum quantity of feather sub-symbols associated with the reels. For instance, in an example embodiment in which the slot game described above with respect to FIGS. 2A to 2E is employed as a free spin bonus game, each designated symbol is associated with a maximum bonus quantity of five feather sub-symbols (which is equal to the largest maximum quantity of feather sub-symbols associated with the reels (reel 205*e* in this example embodiment)) for a play of the free spin bonus game.

In other such embodiments, for a play of the free spin bonus game, for each reel, each designated symbol associated with that reel may be associated with up to the maximum bonus quantity of feather sub-symbols. For instance, in an example embodiment in which the slot game described above with respect to FIGS. 2A to 2E is employed as a free spin bonus game, for each reel, each designated symbol associated with that reel is associated with a minimum quantity of one feather sub-symbol and the maximum bonus quantity of five feather sub-symbols (which is equal to the largest maximum quantity of feather sub-symbols associated with the reels (reel 205*e* in this example embodiment)) for a play of the free spin bonus game.

In certain embodiments, the gaming system triggers a play of the bonus game upon an occurrence of a bonus triggering event. In one embodiment, the bonus triggering event occurs when a particular combination of symbols is displayed. In another embodiment, the bonus triggering event occurs when a set of one or more designated symbols associated with a designated combination and/or a designated quantity of sub-symbols is displayed.

It should be appreciated that the gaming system performs the sub-symbol award evaluation in addition to any other award evaluations, such as the award evaluation for any displayed non-designated symbols and the award evaluation for the designated symbols themselves (if any).

In various embodiments, the quantity of sub-symbols associated with at least one designated symbol varies based on: (a) the player's wager (e.g., the higher the wager, the more feathers associated with that designated symbol); (b) a level or ranking of the player in a player loyalty program (e.g., the higher the player's level in the player loyalty program, the more feathers associated with that designated symbol); (c) whether the player has earned one or more sub-symbols through play of the game and/or through play of a bonus game (e.g., the bonus game enables the player to accumulate sub-symbols for use in the game); and/or (d) a separate random determination (e.g., the gaming system randomly determines the quantity of sub-symbols associated with that designated symbol for a particular play of the game).

In various embodiments, one or more of the designated symbols are not initially associated with any sub-symbols. In this example embodiment, upon an occurrence of a triggering event, the gaming system associates one or more sub-symbols with one or more of those designated symbols. For instance, in one example embodiment, none of the designated symbols are initially associated with any sub-symbols. In this example embodiment, when a designated combination of the designated symbols is displayed (such as winning combination of the designated symbols along a wagered-on payline), for each of those designated symbols, the gaming system associated a randomly-determined quantity of sub-symbols with that designated symbol.

In one such example embodiment, none of the designated symbols are initially associated with any sub-symbols. For a play of the game in this example embodiment, the gaming system spins and stops the reels such that a symbol is displayed at each symbol display area. The gaming system makes a first award determination based on the displayed symbols. If a winning combination of designated symbols is displayed, for each displayed designated symbol in that winning combination, the gaming system randomly determines a quantity of sub-symbols, associates the randomly determined quantity of sub-symbols with that displayed designated symbol, and displays the randomly determined quantity of sub-symbols in association with that displayed designated symbol. After randomly determining and displaying any sub-symbols, the gaming system makes a second award determination based on the sub-symbols, as described above. It should thus be appreciated that, in this example embodiment, the gaming system makes two separate award determinations—one based on the displayed designated and non-designated symbols and another based on the displayed sub-symbols (if any).

In various embodiments, each of one or more of the designated symbols are initially associated with one or more sub-symbols, but the gaming system does not initially display such sub-symbols when the associated designated symbols are displayed. In this example embodiment, upon an occurrence of a triggering event, the gaming system displays any sub-symbols associated with one or more displayed designated symbols. For instance, in one example embodiment, each designated symbol is associated with one or more sub-symbols that are not initially displayed if that designated symbol is displayed. In this example embodiment, when a designated combination of the designated symbols is displayed (such as winning combination of the designated symbols along a wagered-on payline), for each of those designated symbols, the gaming system displays any sub-symbols associated with that designated symbol and performs an award determination based on those displayed sub-symbols.

It should be appreciated that:

(a) the type of non-designated symbols associated with the slot game;
(b) the type of designated symbols associated with the slot game;
(c) the type of sub-symbols associated with the slot game;
(d) the quantity of sub-symbols associated with a particular designated symbol;
(e) the designated quantity of sub-symbols;
(f) the plurality of different characteristics;
(g) which particular characteristic (if any) is associated with a particular designated symbol;
(h) which particular characteristic (if any) is associated with a particular sub-symbol;
(i) the quantity of characteristics;
(j) the minimum quantity of sub-symbols that may be associated with a particular designated symbol;
(k) the maximum quantity of sub-symbols that may be associated with a particular designated symbol;
(l) whether any Wild symbols are employed;
(m) the quantity of symbol display areas;
(n) the arrangement of the symbol display areas;
(o) the quantity of reels;
(p) the particular symbols associated with a particular reel;
(q) the quantity of symbol display areas with which a particular reel is associated;
(r) the particular symbol display areas with which a particular reel is associated;
(s) the number of paylines;
(t) the particular symbol display areas with which each payline is associated;
(u) the type of award evaluation (e.g., payline-based, scatter-based, ways-to-win-based);
(v) whether the award evaluation is based on the characteristic(s) associated with the displayed designated symbol(s) of a particular set, the characteristic(s) associated with the sub-symbols associated with those displayed designated symbol(s), and/or the quantity of sub-symbols associated with those displayed designated symbols;
(w) the award multipliers associated with particular winning conditions;
(x) the particular winning conditions;
(y) the winning non-designated symbol combinations;
(z) the trigger that causes the gaming system to provide the free spin bonus;
(aa) the maximum bonus quantity of symbols; and/or
(bb) any other variables or determinations described herein may be: (1) predetermined; (2) randomly determined; (3) randomly determined based on one or more weighted percentages (such as according to a weighted table); (4) determined based on a generated symbol or symbol combination; (5) determined independent of a generated symbol or symbol combination; (6) determined based on a random determination by a central controller (described below); (7) determined independent of a random determination by the central controller; (8) determined based on a random determination at an EGM configured to operate the slot game (described below); (9) determined independent of a random determination at the EGM; (10) determined based on at least one play of at least one game; (11) determined independent of at least one play of at least one game; (12) determined based on a player's selection; (13) determined independent of a player's selection; (14) determined based on one or more side wagers placed; (15) determined independent of one or more side wagers placed; (16) determined based on the player's primary game wager or wager level; (17) determined independent of the player's primary game wager or wager level; (18) determined based on time (such as the time of day); (19) determined independent of time (such as the time of day); (20) determined based on an amount of coin-in accumulated in one or more pools; (21) determined independent of an amount of coin-in accumulated in one or more pools; (22) determined based on a status of the player (i.e., a player tracking status); (23) determined independent of a status of the player (i.e., a player tracking status); (24) determined based on one or more other determinations disclosed herein; (25) determined independent of any other determination disclosed herein; and/or (26) determined in any other suitable manner or based on or independent of any other suitable factor(s).

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 7A:
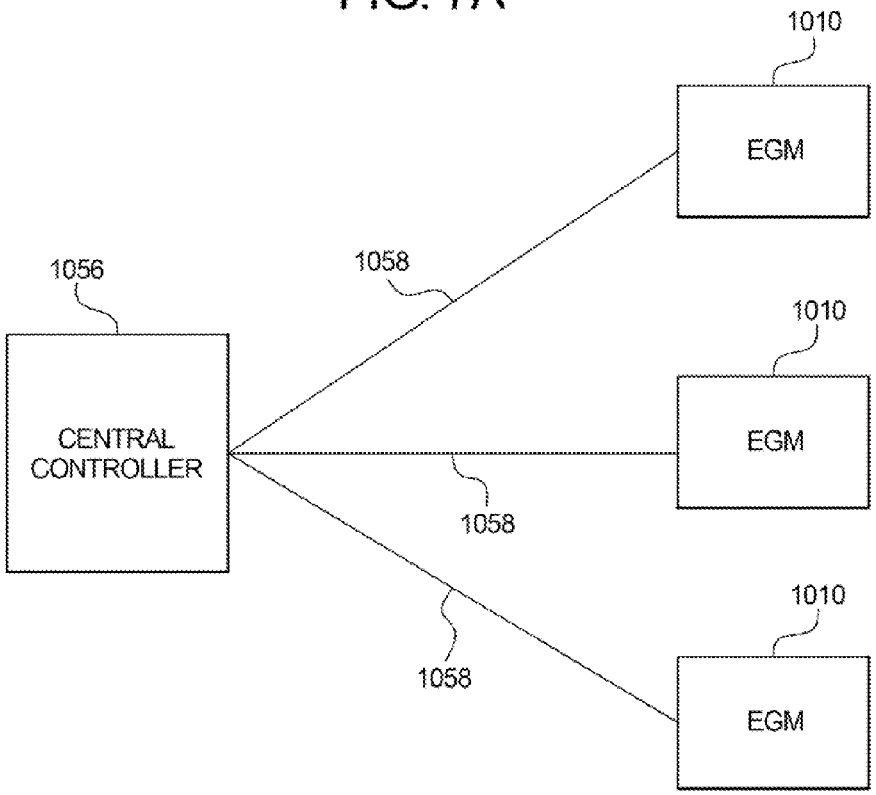
FIG. 7A is a schematic block diagram of one embodiment of a network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 7A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber fine (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 7B:
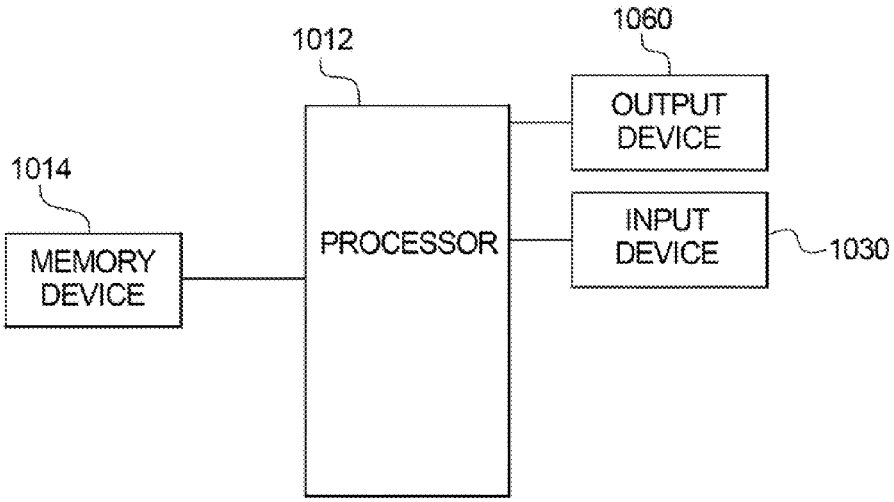
FIG. 7B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 7B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 7B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 8A:
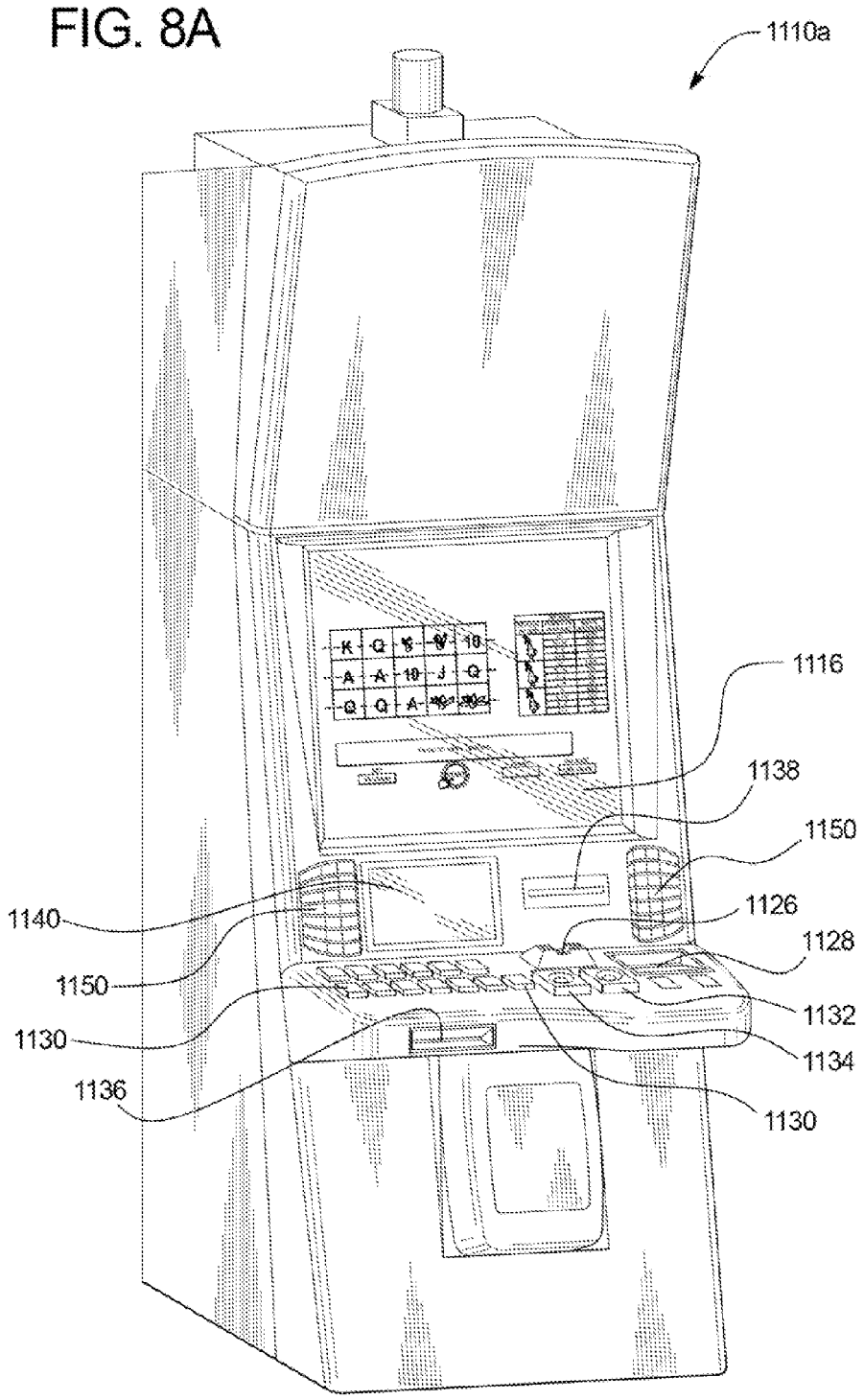
FIGS. 8A and 8B are perspective views of example alternative embodiments of the gaming system of the present disclosure.
Figure 8B:
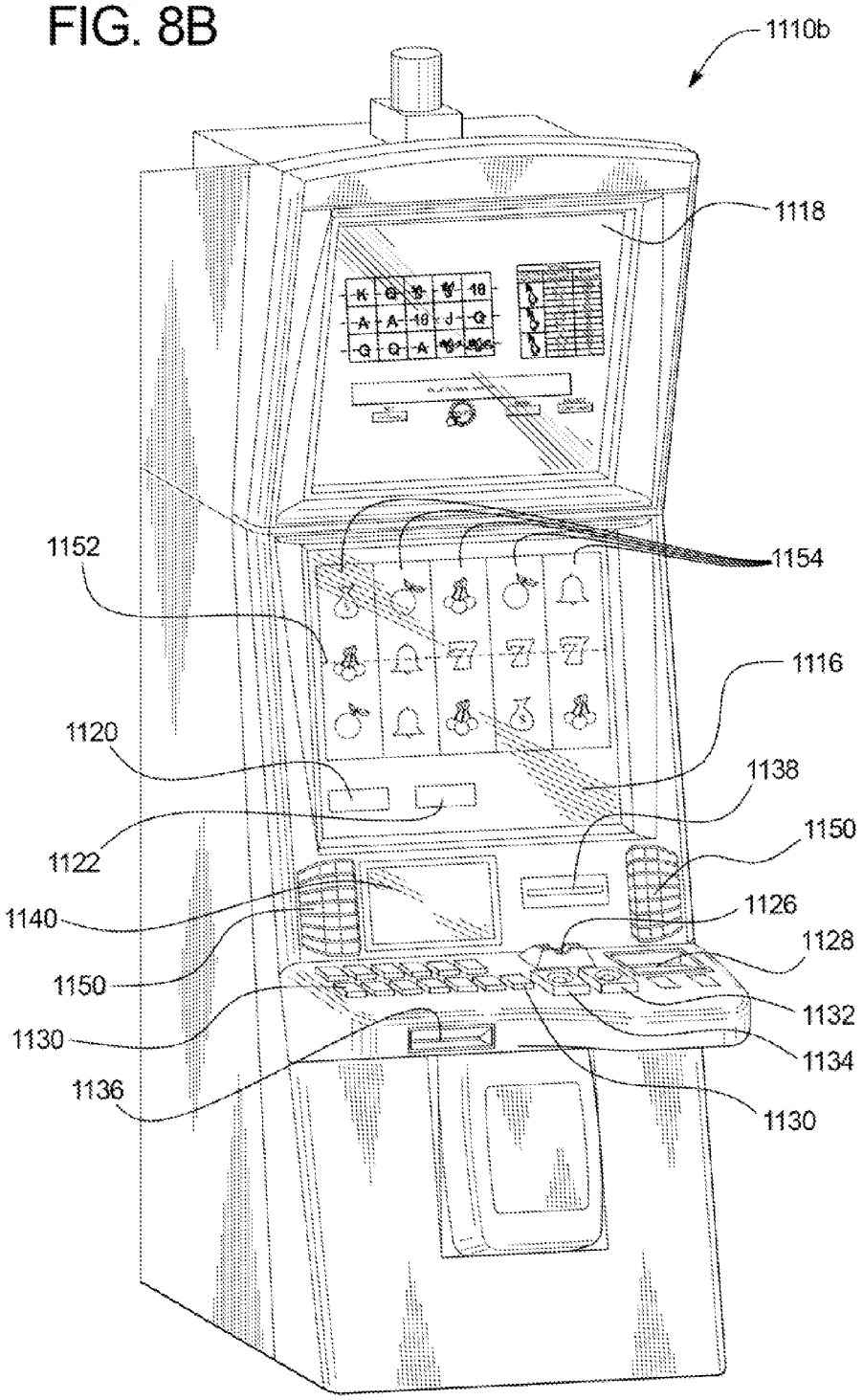

In various embodiments, the EGM includes one or more input devices. The input devices may include any suitable device that enables an input signal to be produced and received by the at least one processor of the EGM. The example EGM illustrated in FIG. 7B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 8A and 8B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 8A and 8B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 8A and 8B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 8A and 8B each include a card reader 1138. The card reader is configured to read a player identification card inserted into the card reader.

In various embodiments, the EGM includes one or more output devices. The example EGM illustrated in FIG. 7B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 8A includes a central display device 1116, a player tracking display 1140, a credit display 1120, and a bet display 1122. The example EGM illustrated in FIG. 8B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 8A and 8B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 8A and 8B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 8A and 8B, the EGM has a support structure housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 8A and 8B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games, and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGM shown in FIG. 8B includes a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108406 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game (s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A gaming system comprising:

a housing;

a plurality of input devices supported by the housing, the plurality of input devices including an acceptor;

at least one display device supported by the housing;

at least one processor; and at least one memory device that stores a plurality of instructions which, when executed by the at least one processor, cause the at least one processor to operate with the plurality of input devices and the at least one display device to:

(a) establish a credit balance associated with a monetary value of a physical item after the acceptor receives the physical item;

(b) place a wager on a play of a game after an actuation of a wager button is received, the credit balance being decreasable by the wager;

(c) initiate the play of the game, which is associated with a plurality of different symbols, wherein:

(i) the plurality of different symbols includes a plurality of non-designated symbols and a plurality of designated symbols, each designated symbol being associated with one of a plurality of different characteristics;

(ii) each designated symbol is associated with one or more of a plurality of different sub-symbols, each sub-symbol being associated with one of the plurality of different characteristics;

(iii) for each designated symbol, said designated symbol and the one or more sub-symbols associated with said designated symbol are associated with a same one of the plurality of different characteristics; and (iv) a first designated symbol and its associated one or more sub-symbols are associated with a first characteristic and a second different designated symbol and its associated one or more sub-symbols are associated with a second different characteristic;

(d) for each of a plurality of symbol display areas, randomly generate and display one of the plurality of different symbols and any sub-symbols associated with said symbol at said symbol display area;

(e) determine and display any awards associated with any displayed non-designated symbols;

(f) if at least one set of one or more designated symbols that: (A) are each associated with a same one of the characteristics, and (B) are collectively associated with at least a designated quantity of sub-symbols associated with said same one of the characteristics is displayed, for each said set, determine and display an award associated with said set based on:

(i) the characteristic associated with the one or more displayed designated symbols and associated sub-symbols of said set, and (ii) a quantity of sub-symbols that are collectively associated with the one or more displayed designated symbols of said set, the credit balance being increasable by the award, wherein:

(i) the award is a first award when the characteristic associated with the one or more displayed designated symbols and associated sub-symbols of said set is a first characteristic and the quantity of sub-symbols that are collectively associated with the one or more displayed designated symbols of said set is a first quantity;

(ii) the award is a second award when the characteristic associated with the one or more displayed designated symbols and associated sub-symbols of said set is a second different characteristic and the quantity of sub-symbols that are collectively associated with the one or more displayed designated symbols of said set is the first quantity, the second award being different than the first award; and (iii) the award is a third award when the characteristic associated with the one or more displayed designated symbols and associated sub-symbols of said set is the first characteristic and the quantity of sub-symbols that are collectively associated with the one or more displayed designated symbols of said set is a second different quantity, the third award being different than the first award; and (g) initiate a payout associated with the credit balance after an actuation of a cashout button is received.

2. The gaming system of claim 1, wherein the game is associated with a plurality of reels and each of the plurality of different symbols is associated with one of the reels.

3. The gaming system of claim 2, wherein each designated symbol associated with a first reel is associated with up to a first maximum quantity of sub-symbols and each designated symbol associated with a second different reel is associated with up to a second different maximum quantity of sub-symbols.

4. The gaming system of claim 3, wherein the maximum quantity of sub-symbols associated with each designated symbol of each reel is different.

5. The gaming system of claim 2, wherein each designated symbol associated with a first reel is associated with a first maximum quantity of sub-symbols and each designated symbol associated with a second different reel is associated with a second maximum quantity of sub-symbols.

6. The gaming system of claim 1, wherein the second quantity is greater than the first quantity and the third award is greater than the first award.

7. A method of operating a gaming system, said method comprising:

(a) causing at least one processor to execute a plurality of instructions stored in at least one memory device to establish a credit balance associated with a monetary value of a physical item after an acceptor supported by a housing of the gaming system receives the physical item;

(b) causing the at least one processor to execute the plurality of instructions to place a wager on a play of a game after an actuation of a wager button is received, the credit balance being decreasable by the wager;

(c) causing the at least one processor to execute the plurality of instructions to initiate the play of the game, which is associated with a plurality of different symbols, wherein:

(i) the plurality of different symbols includes a plurality of non-designated symbols and a plurality of designated symbols, each designated symbol being associated with one of a plurality of different characteristics;

(ii) each designated symbol is associated with one or more of a plurality of different sub-symbols, each sub-symbol being associated with one of the plurality of different characteristics;

(iii) for each designated symbol, said designated symbol and the one or more sub-symbols associated with said designated symbol are associated with a same one of the plurality of different characteristics; and (iv) a first designated symbol and its associated one or more sub-symbols are associated with a first characteristic and a second different designated symbol and its associated one or more sub-symbols are associated with a second different characteristic;

(d) for each of a plurality of symbol display areas, causing the at least one processor to execute the plurality of instructions to operate with at least one display device to display one of the plurality of different symbols and any sub-symbols associated with said symbol at said symbol display area;

(e) causing the at least one processor to execute the plurality of instructions to determine and operate with the at least one display device to display any awards associated with any displayed non-designated symbols;

(f) if at least one set of one or more designated symbols that: (A) are each associated with a same one of the characteristics, and (B) are collectively associated with at least a designated quantity of sub-symbols associated with said same one of the characteristics is displayed, for each said set, causing the at least one processor to execute the plurality of instructions to determine and operate with the at least one display device to display an award associated with said set based on:

(i) the characteristic associated with the one or more displayed designated symbols and associated sub-symbols of said set, and (ii) a quantity of sub-symbols that are collectively associated with the one or more displayed designated symbols of said set, the credit balance being increasable by the award, wherein:

(i) the award is a first award when the characteristic associated with the one or more displayed designated symbols and associated sub-symbols of said set is a first characteristic and the quantity of sub-symbols that are collectively associated with the one or more displayed designated symbols of said set is a first quantity;

(ii) the award is a second award when the characteristic associated with the one or more displayed designated symbols and associated sub-symbols of said set is a second different characteristic and the quantity of sub-symbols that are collectively associated with the one or more displayed designated symbols of said set is the first quantity, the second award being different than the first award; and (iii) the award is a third award when the characteristic associated with the one or more displayed designated symbols and associated sub-symbols of said set is the first characteristic and the quantity of sub-symbols that are collectively associated with the one or more displayed designated symbols of said set is a second different quantity, the third award being different than the first award; and (g) causing the at least one processor to execute the plurality of instructions to initiate a payout associated with the credit balance after an actuation of a cashout button is received.

8. The method of claim 7, wherein the game is associated with a plurality of reels and each of the plurality of different symbols is associated with one of the reels.

9. The method of claim 8, wherein each designated symbol associated with a first reel is associated with up to a first maximum quantity of sub-symbols and each designated symbol associated with a second different reel is associated with up to a second different maximum quantity of sub-symbols.

10. The method of claim 9, wherein the maximum quantity of sub-symbols associated with each designated symbol of each reel is different.

11. The method of claim 8, wherein each designated symbol associated with a first reel is associated with a first maximum quantity of sub-symbols and each designated symbol associated with a second different reel is associated with a second maximum quantity of sub-symbols.

12. The method of claim 7, wherein the second quantity is greater than the first quantity and the third award is greater than the first award.

13. The method of claim 7, which is provided through a data network.

14. The method of claim 13, wherein the data network is an internet.

15. A non-transitory computer readable medium that stores a plurality of instructions which, when executed by at least one processor, cause the at least one processor to:

(a) establish a credit balance associated with a monetary value of a physical item after an acceptor supported by a housing of the gaming system receives the physical item;

(b) place a wager on a play of a game after an actuation of a wager button of the gaming system is received, the credit balance being decreasable by the wager;

(c) initiate the play of the game, which is associated with a plurality of different symbols, wherein:

(i) the plurality of different symbols includes a plurality of non-designated symbols and a plurality of designated symbols, each designated symbol being associated with one of a plurality of different characteristics;

(ii) each designated symbol is associated with one or more of a plurality of different sub-symbols, each sub-symbol being associated with one of the plurality of different characteristics;

(iii) for each designated symbol, said designated symbol and the one or more sub-symbols associated with said designated symbol are associated with a same one of the plurality of different characteristics; and (iv) a first designated symbol and its associated one or more sub-symbols are associated with a first characteristic and a second different designated symbol and its associated one or more sub-symbols are associated with a second different characteristic;

(d) for each of a plurality of symbol display areas, cause at least one display device to display one of the plurality of different symbols and any sub-symbols associated with said symbol at said symbol display area;

(e) determine and cause the at least one display device to display any awards associated with any displayed non-designated symbols;

(f) if at least one set of one or more designated symbols that: (A) are each associated with a same one of the characteristics, and (B) are collectively associated with at least a designated quantity of sub-symbols associated with said same one of the characteristics is displayed, for each said set, determine and cause the at least one display device to display an award associated with said set based on:

(i) the characteristic associated with the one or more displayed designated symbols and associated sub-symbols of said set, and (ii) a quantity of sub-symbols that are collectively associated with the one or more displayed designated symbols of said set, the credit balance being increasable by the award, wherein:

(i) the award is a first award when the characteristic associated with the one or more displayed designated symbols and associated sub-symbols of said set is a first characteristic and the quantity of sub-symbols that are collectively associated with the one or more displayed designated symbols of said set is a first quantity;

(ii) the award is a second award when the characteristic associated with the one or more displayed designated symbols and associated sub-symbols of said set is a second different characteristic and the quantity of sub-symbols that are collectively associated with the one or more displayed designated symbols of said set is the first quantity, the second award being different than the first award; and (iii) the award is a third award when the characteristic associated with the one or more displayed designated symbols and associated sub-symbols of said set is the first characteristic and the quantity of sub-symbols that are collectively associated with the one or more displayed designated symbols of said set is a second different quantity, the third award being different than the first award; and (g) initiate a payout associated with the credit balance after an actuation of a cashout button is received.

16. The non-transitory computer readable medium of claim 15, wherein the game is associated with a plurality of reels and each of the plurality of different symbols is associated with one of the reels.

17. The non-transitory computer readable medium of claim 16, wherein each designated symbol associated with a first reel is associated with up to a first maximum quantity of sub-symbols and each designated symbol associated with a second different reel is associated with up to a second different maximum quantity of sub-symbols.

18. The non-transitory computer readable medium of claim 17, wherein the maximum quantity of sub-symbols associated with each designated symbol of each reel is different.

19. The non-transitory computer readable medium of claim 16, wherein each designated symbol associated with a first reel is associated with a first maximum quantity of sub-symbols and each designated symbol associated with a second different reel is associated with a second maximum quantity of sub-symbols.

20. The non-transitory computer readable medium of claim 15, wherein the second quantity is greater than the first quantity and the third award is greater than the first award.

* * * * *